US007563209B2

(12) United States Patent
Webber et al.

(10) Patent No.: US 7,563,209 B2
(45) Date of Patent: Jul. 21, 2009

(54) LEG EXERCISE MACHINE WITH SELF-ALIGNING PIVOTING SEAT

(75) Inventors: Randall T. Webber, La Jolla, CA (US); Jeffrey O. Meredith, Del Mar, CA (US)

(73) Assignee: Hoist Fitness Systems, Inc., San Diego, CA (US)

( * ) Notice: Subject to any disclaimer, the term of this patent is extended or adjusted under 35 U.S.C. 154(b) by 0 days.

(21) Appl. No.: 11/846,472

(22) Filed: Aug. 28, 2007

(65) Prior Publication Data

US 2008/0058177 A1 Mar. 6, 2008

Related U.S. Application Data

(60) Provisional application No. 60/824,577, filed on Sep. 5, 2006.

(51) Int. Cl.
*A63B 21/06* (2006.01)

(52) U.S. Cl. ..... 482/94; 482/96; 482/100; 482/137

(58) Field of Classification Search ..... 482/66, 482/80, 93–101, 130, 133–137, 142
See application file for complete search history.

(56) References Cited

U.S. PATENT DOCUMENTS

| | | | | |
|---|---|---|---|---|
| 248,121 | A | 10/1881 | Tuttle | |
| 2,145,940 | A * | 2/1939 | Marlowe | 482/72 |
| 2,252,156 | A | 8/1941 | Bell | |
| 3,446,503 | A | 5/1969 | Lawton | |
| 3,592,465 | A | 7/1971 | Fulkerson, Jr. | |
| 3,640,528 | A | 2/1972 | Proctor | |
| 3,707,285 | A | 12/1972 | Martin | |
| 4,004,801 | A | 1/1977 | Campanaro et al. | |
| 4,111,414 | A | 9/1978 | Roberts | |
| 4,231,568 | A | 11/1980 | Riley et al. | |
| 4,300,760 | A | 11/1981 | Bobroff | |
| 4,441,708 | A * | 4/1984 | Brentham | 482/112 |

(Continued)

FOREIGN PATENT DOCUMENTS

| | | |
|---|---|---|
| CA | 2075331 | 2/1994 |

(Continued)

OTHER PUBLICATIONS

U.S. Appl. No. 11/846,437, filed Aug. 2007, Webber et al.

(Continued)

*Primary Examiner*—Fenn C Mathew
*Assistant Examiner*—Andrew M Tecco
(74) *Attorney, Agent, or Firm*—Procopio, Cory, Hargreaves & Savitch, LLP

(57) ABSTRACT

An isolation exercise machine for exercising one muscle group has a user support which is pivotally mounted on a main frame by a pivotal mounting system. A user engaging exercise arm is pivotally connected to the user support, and a connecting link links movement of the user exercise arm to movement in the user support. A load provides resistance to movement of the user support, exercise arm and/or connecting link. The pivotal mounting system is configured to place the user support seat in a relatively flat position in the rest or exercise start position and to recline and change the seat angle to an inclined position as the exercise arm is moved.

25 Claims, 38 Drawing Sheets

U.S. PATENT DOCUMENTS

| | | | | | |
|---|---|---|---|---|---|
| 4,448,412 | A | | 5/1984 | Brentham | |
| 4,632,390 | A | | 12/1986 | Richey | |
| 4,641,833 | A | * | 2/1987 | Trethewey | 482/95 |
| 4,700,946 | A | | 10/1987 | Breunig | |
| 4,743,010 | A | * | 5/1988 | Geraci | 482/72 |
| 4,793,608 | A | | 12/1988 | Mahnke et al. | |
| 4,822,038 | A | * | 4/1989 | Maag | 482/97 |
| 4,844,456 | A | * | 7/1989 | Habing et al. | 482/100 |
| 4,911,438 | A | | 3/1990 | Van Straaten | |
| 4,949,951 | A | | 8/1990 | Deola | |
| 4,949,958 | A | * | 8/1990 | Richey | 482/96 |
| 5,066,003 | A | | 11/1991 | Jones | |
| 5,066,004 | A | | 11/1991 | Jones | |
| 5,100,128 | A | | 3/1992 | Mabry | |
| 5,106,081 | A | | 4/1992 | Webb | |
| 5,108,095 | A | | 4/1992 | Nichols | |
| 5,250,013 | A | | 10/1993 | Brangi | |
| 5,254,067 | A | * | 10/1993 | Habing et al. | 482/137 |
| 5,263,914 | A | | 11/1993 | Simonson et al. | |
| 5,267,930 | A | | 12/1993 | Henes | |
| 5,299,997 | A | | 4/1994 | Chen | |
| 5,322,489 | A | | 6/1994 | Webb | |
| 5,330,404 | A | | 7/1994 | Lopeleguy et al. | |
| 5,330,405 | A | * | 7/1994 | Habing et al. | 482/96 |
| 5,334,120 | A | | 8/1994 | Rasmussen | |
| 5,342,269 | A | | 8/1994 | Huang et al. | |
| 5,346,447 | A | | 9/1994 | Stearns | |
| 5,352,171 | A | | 10/1994 | Lin | |
| 5,354,248 | A | | 10/1994 | Rawls et al. | |
| 5,356,357 | A | | 10/1994 | Wang et al. | |
| 5,356,358 | A | | 10/1994 | Chen | |
| D357,041 | S | | 4/1995 | McBride et al. | |
| 5,417,634 | A | | 5/1995 | Habing | |
| 5,421,796 | A | | 6/1995 | Jones et al. | |
| 5,437,589 | A | | 8/1995 | Habing | |
| 5,447,480 | A | | 9/1995 | Fulks | |
| 5,453,066 | A | | 9/1995 | Richter, Jr. | |
| 5,458,553 | A | | 10/1995 | Wu | |
| 5,478,298 | A | | 12/1995 | Chen | |
| 5,499,959 | A | | 3/1996 | Holmes et al. | |
| 5,503,608 | A | | 4/1996 | Chang | |
| 5,507,710 | A | | 4/1996 | Chen | |
| 5,520,599 | A | | 5/1996 | Chen | |
| 5,527,243 | A | | 6/1996 | Chen | |
| 5,527,249 | A | | 6/1996 | Harris | |
| 5,533,953 | A | * | 7/1996 | Lui et al. | 482/96 |
| 5,540,639 | A | | 7/1996 | Potts et al. | |
| D372,509 | S | * | 8/1996 | Yang | D21/676 |
| 5,547,444 | A | | 8/1996 | Huang | |
| 5,549,530 | A | | 8/1996 | Fulks | |
| 5,554,086 | A | | 9/1996 | Habing et al. | |
| 5,562,577 | A | | 10/1996 | Nichols et al. | |
| 5,573,482 | A | | 11/1996 | Wang et al. | |
| 5,580,340 | A | * | 12/1996 | Yu | 482/96 |
| 5,580,341 | A | | 12/1996 | Simonson | |
| 5,582,563 | A | | 12/1996 | Fan | |
| 5,603,678 | A | | 2/1997 | Wilson | |
| 5,626,542 | A | | 5/1997 | Dalebout et al. | |
| 5,643,147 | A | | 7/1997 | Huang | |
| 5,643,152 | A | | 7/1997 | Simonson | |
| 5,658,227 | A | | 8/1997 | Stearns | |
| 5,669,865 | A | * | 9/1997 | Gordon | 482/142 |
| 5,672,142 | A | | 9/1997 | Wu | |
| 5,674,161 | A | | 10/1997 | Lin | |
| 5,676,626 | A | | 10/1997 | Huang | |
| 5,683,334 | A | | 11/1997 | Webber | |
| 5,695,434 | A | | 12/1997 | Dalebout et al. | |
| 5,702,328 | A | | 12/1997 | Mansvelt | |
| 5,720,695 | A | * | 2/1998 | Eckmann | 482/72 |
| 5,722,918 | A | | 3/1998 | Lee | |
| 5,733,229 | A | | 3/1998 | Dalebout et al. | |
| 5,733,232 | A | | 3/1998 | Hsu | |
| 5,749,813 | A | | 5/1998 | Domzalski | |
| 5,803,882 | A | | 9/1998 | Habling et al. | |
| 5,810,698 | A | | 9/1998 | Hullett et al. | |
| 5,810,701 | A | | 9/1998 | Ellis et al. | |
| 5,827,158 | A | | 10/1998 | Drecksel | |
| 5,876,095 | A | | 3/1999 | Johnston | |
| 5,899,836 | A | | 5/1999 | Chen | |
| 5,906,564 | A | | 5/1999 | Jacobsen | |
| 5,938,570 | A | | 8/1999 | Maresh | |
| 5,938,571 | A | | 8/1999 | Stevens | |
| 5,944,641 | A | * | 8/1999 | Habing | 482/96 |
| 5,961,427 | A | | 10/1999 | Habing et al. | |
| 5,967,954 | A | | 10/1999 | Habling | |
| 5,989,165 | A | | 11/1999 | Gianelli et al. | |
| 5,997,446 | A | | 12/1999 | Stearns | |
| 5,997,447 | A | | 12/1999 | Gianelli et al. | |
| 6,024,677 | A | | 2/2000 | Siwertz | |
| 6,071,216 | A | | 6/2000 | Gianelli et al. | |
| 6,074,328 | A | | 6/2000 | Johnson | |
| 6,080,091 | A | | 6/2000 | Habing et al. | |
| 6,086,521 | A | | 7/2000 | Solland | |
| 6,142,917 | A | | 11/2000 | Gianelli et al. | |
| 6,152,864 | A | | 11/2000 | Gianelli et al. | |
| 6,162,153 | A | | 12/2000 | Perez et al. | |
| 6,244,995 | B1 | | 6/2001 | Prsala | |
| 6,251,047 | B1 | | 6/2001 | Stearns et al. | |
| 6,264,588 | B1 | | 7/2001 | Ellis | |
| 6,302,832 | B1 | | 10/2001 | Stearns | |
| 6,312,366 | B1 | | 11/2001 | Prusick | |
| 6,319,178 | B1 | | 11/2001 | Webber | |
| 6,387,020 | B1 | | 5/2002 | Simonson | |
| 6,394,937 | B1 | | 5/2002 | Voris | |
| 6,491,609 | B2 | | 12/2002 | Webber | |
| 6,605,024 | B2 | | 8/2003 | Stearns | |
| 6,676,577 | B2 | | 1/2004 | Stearns | |
| 6,752,748 | B1 | | 6/2004 | Scotti | |
| 6,811,522 | B1 | | 11/2004 | McQuinn | |
| 6,855,098 | B2 | | 2/2005 | Reitz et al. | |
| 6,916,278 | B2 | | 7/2005 | Webber | |
| 6,966,872 | B2 | | 11/2005 | Eschenbach | |
| 6,971,978 | B2 | | 12/2005 | Hyder | |
| 7,052,444 | B2 | | 5/2006 | Webber | |
| 7,052,446 | B2 | | 5/2006 | Morris et al. | |
| 7,070,545 | B2 | | 7/2006 | Lull et al. | |
| 7,141,003 | B2 | | 11/2006 | Wu | |
| 7,141,008 | B2 | | 11/2006 | Krull et al. | |
| 7,220,221 | B2 | | 5/2007 | Mosimann et al. | |
| 7,223,213 | B2 | * | 5/2007 | Golesh | 482/100 |
| 7,229,389 | B2 | | 6/2007 | Hong | |
| 7,331,911 | B2 | | 2/2008 | Webber et al. | |
| 7,335,140 | B2 | | 2/2008 | Webber et al. | |
| 7,361,125 | B2 | | 4/2008 | Webber et al. | |
| 7,384,381 | B2 | | 6/2008 | Webber et al. | |
| 7,468,024 | B2 | | 12/2008 | Webber et al. | |
| 2002/0103058 | A1 | | 8/2002 | Webber | |
| 2002/0187879 | A1 | | 12/2002 | Ball et al. | |
| 2003/0199362 | A1 | * | 10/2003 | Chamberlin | 482/1 |
| 2005/0032611 | A1 | | 2/2005 | Webber et al. | |
| 2005/0096196 | A1 | | 5/2005 | Webber et al. | |
| 2005/0096197 | A1 | | 5/2005 | Webber et al. | |
| 2005/0096198 | A1 | | 5/2005 | Webber et al. | |
| 2006/0211549 | A1 | | 9/2006 | Nohejl | |
| 2006/0247107 | A1 | | 11/2006 | Carter | |
| 2006/0276313 | A1 | * | 12/2006 | Hong | 482/95 |
| 2007/0232462 | A1 | | 10/2007 | Webber et al. | |
| 2007/0293377 | A1 | | 12/2007 | Webber et al. | |
| 2007/0293378 | A1 | | 12/2007 | Webber et al. | |
| 2008/0058176 | A1 | | 3/2008 | Webber et al. | |
| 2008/0132389 | A1 | | 6/2008 | Webber et al. | |
| 2008/0153677 | A1 | | 6/2008 | Webber et al. | |
| 2008/0182732 | A1 | | 7/2008 | Webber et al. | |
| 2008/0214365 | A1 | | 9/2008 | Webber et al. | |

| | | | |
|---|---|---|---|
| 2008/0214367 | A1 | 9/2008 | Webber et al. |
| 2008/0220950 | A1 | 9/2008 | Webber et al. |
| 2008/0234110 | A1 | 9/2008 | Webber et al. |
| 2008/0242517 | A1 | 10/2008 | Webber et al. |
| 2008/0248929 | A1 | 10/2008 | Webber et al. |

FOREIGN PATENT DOCUMENTS

| | | | |
|---|---|---|---|
| SU | 1674874 | A1 | 9/1991 |

OTHER PUBLICATIONS

U.S. Appl. No. 11/849,028, filed Aug. 2007, Webber et al.
U.S. Appl. No. 11/848,012, filed Aug. 2007, Webber et al.
U.S. Appl. No. 11/846,459, filed Aug. 2007, Webber et al.
Boss Fitness Brochure, 1993.
Hammer Strength, Hammer Brochure, 1993.
FS-403 Shoulder Press, Flex Brochure, 1995.
Paramount Advanced Performance System—Legg Press AP—2800 (brochure dated 2000).
08003 Rower, Gym 80 Brochure, 2001.
Gym 80 Brochure, 2001.
Leg Press, Cybex International Brochure, 2002.
Flex Fitness Brochure, date unknown.
Pace, 318 Dip/Shrug, Hanley International Brochure, date unknown.
FA-508 Dip Machine, Flex Brochure, date unknown.
Sprint by Hogan Industries, date unknown.
Models 217 and 206-2, Polaris Brochure, date unknown.
Hoist Selectionized Duals HD Series, Hoist Brochure, 2002.
Gravity Gym Instruction Manual, Seated Bench Press, date unknown.
Seated Close Grip Bench Press, Gravity Gym Instruction Manual, date unknown.
Vertical Bench Press Machine, Hoist Brochure, 1993.
Sprint by Hogan Industries, Linear Motion Chest Press, date unknown.
Chest Press and Incline Press, plate-loaded, Cybex Brochure, 1996.
Leg Press Machine, Schwinn Natural Strength, European trade magazine, date uknown.
Low Back Machine, Hoist Brochure, HS1225, 2005.
How It Works Flyer, illustration of exercises performed on U.S. Patent No. 5,527,249 of Harris, date unknown.
Sprint Circuit, Hogan Industries Brochure, date unknown.
Notice of Allowance of Nov. 30, 2007 in U.S. Appl. No. 10/698,908.
Office Action of Aug. 10, 2007 in U.S. Appl. No. 10/698,908.
Office Action of Nov. 14, 2006 in U.S. Appl. No. 10/698,908.
FL-103 Hamtractor and FL-104 Hamflexor, FlexFitness Brochure, 2002.
Leg Extension, Nautilus Brochure, date unknown.
CX108 Super Leg Curl and CX109 Super Leg Extension, Body Masters Brochure, 2002.
CL2402, Hoist Fitness Systems Owner's Manual, Aug. 2000.
CD 2400 Leg Extension/Leg Curl, Hoist Fitness Systems, Owner's Catalog 2005.
Hoist CL, CD, CF and F Series Brochure, CD2400 Machine, CD2401, Hoist Fitness Systems, 2005.

* cited by examiner

LEG EXERCISE MACHINE WITH SELF-ALIGNING PIVOTING SEAT

RELATED APPLICATION

The present application claims the benefit of co-pending U.S. provisional patent application No. 60/824,577 filed Sep. 5, 2006, which is incorporated herein by reference in its entirety.

BACKGROUND

1. Field of the Invention

This invention relates generally to an exercise machine for performing isolation exercises, and is particularly concerned with a leg exercise machine with a self-aligning pivoting seat.

2. Related Art

The three most widely performed leg exercises are the leg extension, leg curl, and leg press exercise. Between them, these exercises cover all of the lower body's major muscle groups. The leg press is compound movement, requiring movement of multiple joints. The leg extension and the leg curl are isolation exercises, so called because they involve a single joint, the knee; require the movement of just one body part, the lower leg; and target a specific muscle group, specifically the quadriceps in a leg extension and the hamstring in a leg curl. Because only one joint action is involved, isolation exercise machines generally use exercise arms with rotational movement that align the pivoting joint of the user with the pivot axis of the arm. In order to reduce joint stress and prevent injury, the user should be properly positioned and supported when performing such exercises.

Existing isolation movement leg exercise machines generally have a stationary user support or seat. Some leg exercise machines have a relatively flat user seat which puts the user in a slight recline. This is easy for the user to enter and exit but does not provide adequate pre-stretch in the beginning of the exercise. With a sufficient load, the user's hips may tend to lift during the exercise. To counter this, seat belts are sometimes added to keep the user in place, or the seat is placed at a steeper angle. The steep angle makes it difficult for users to exit the machine. Although this type of machine provides ample exercise range at the beginning of the exercise, it can be limited at the top end of the movement.

Some known leg extension and leg curl machines have moving user supports, but it is often difficult for the user to maintain balance on the user support in these machines.

SUMMARY

In one embodiment, an isolation exercise machine for exercising one muscle group has a user support which is pivotally mounted on a main frame by a pivotal mounting system. A user engaging exercise arm is pivotally connected to the user support in one embodiment, and a connecting link links movement of the user exercise arm to movement in the user support. A load provides resistance to movement of the user support, exercise arm and/or connecting link. Where the exercise machine is for performing isolation leg exercises such as leg extension and leg curls, the pivotal mounting system is configured to place the user support seat in a relatively flat position in the rest or exercise start position and to recline and change the seat angle to an inclined position as the exercise arm is moved. By pivoting the user support and tying its pivoting action to the movement of the exercise arm, the advantages of a relatively flat seat and an inclined seat in a leg exercise machine are combined. In one embodiment, the pivotal mounting system is a four-bar pivotal linkage system having first and second links connecting to first and second pivots on the main frame and user support, respectively.

The exercise machine may be designed for performing leg extensions or leg curls, or may be a combination leg extension and leg curl machine. In one embodiment, the starting seat height is relatively low to the ground to make entering, position adjustment and exiting easier. As soon as the exercise arm is engaged, the seat starts to recline to maintain the beginning pre-stretch and continues to recline as the arm is extended upward and the user straightens their legs. The finishing position is not as severely angled as some current designs so that the user can achieve a relatively full extension to their legs.

Because the pivoting action of the seat drops the user's hips while it raises their knees, the user stays firmly planted in the user support. There is little or no teeter-totter effect with the hips trying to lift up off of the seat. Instead, the pivoting seat is continuously moving the user's hips in a downward direction.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
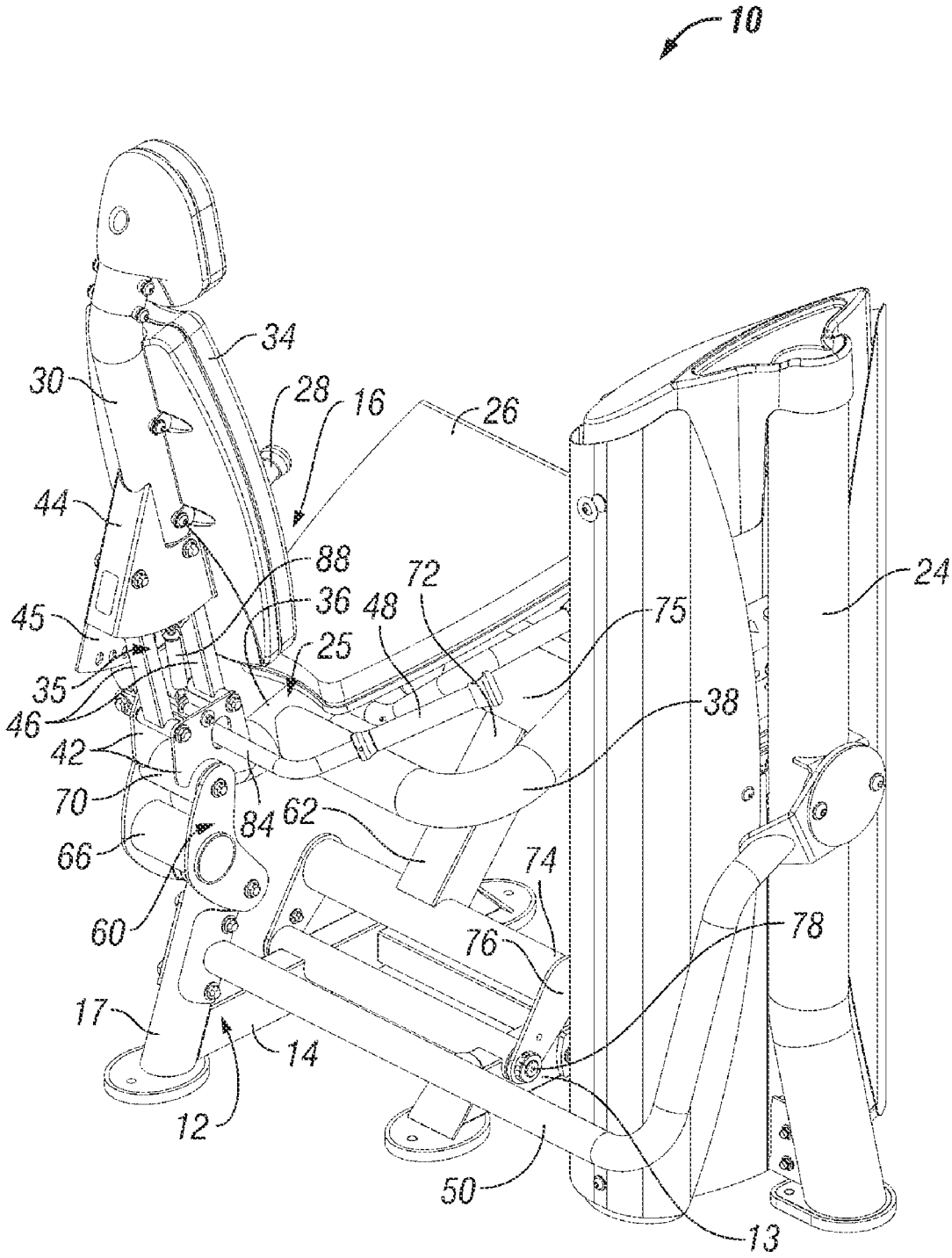
FIG. 1 is a rear perspective view of a leg extension exercise machine according to a first embodiment.

Certain embodiments as disclosed herein provide for leg exercise machines with a self-aligning pivoting seat or user support, designed for performing leg extension exercises, leg curl exercises, or both types of exercises on a single machine. Leg extension and leg curl exercises are isolation exercises in which a single joint, the knee, is involved, and in which only one body part is moved, specifically the lower leg. Isolation exercises target a specific muscle group, for example the quadriceps in the case of a leg extension and the hamstring in the case of a leg curl. In certain embodiments disclosed herein, a pivoting user support is linked to a leg exercise arm for movement with the arm.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 7 illustrate a leg extension exercise machine 10 according to a first embodiment. Machine 10 comprises a main frame 12, a user support 16 pivotally mounted on the frame by a four-bar pivoting linkage system 18 (see FIGS. 5A and 5B), a leg exercise arm assembly 20 pivotally secured to the seat section of the user support, a connecting link 22 which links movement of the exercise arm to movement of the user support, and a weight stack frame 24 positioned to one side of the main frame.

Figure 3:
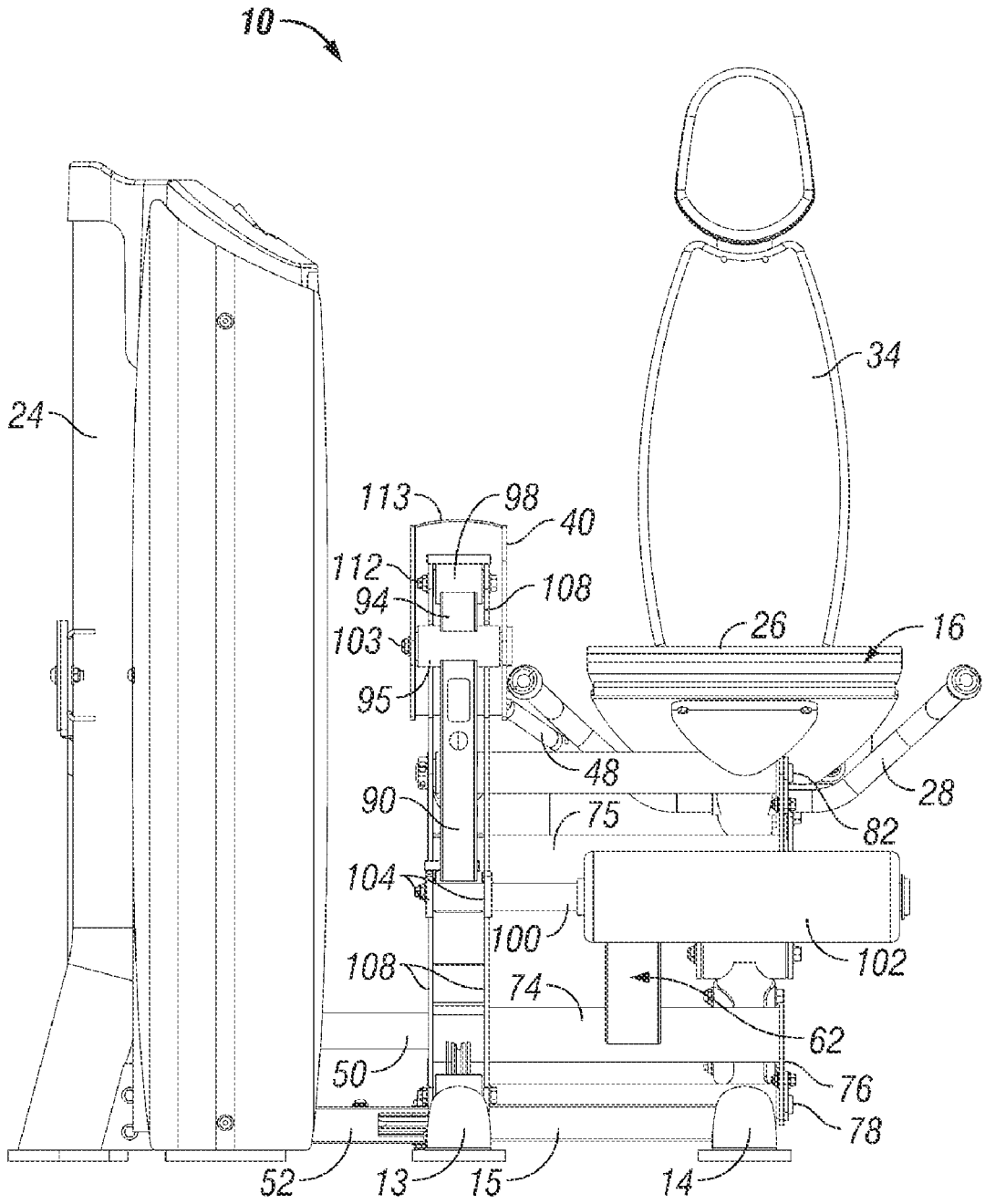
FIG. 3 is a front elevation view of the machine of FIGS. 1 and 2.
Figure 4:
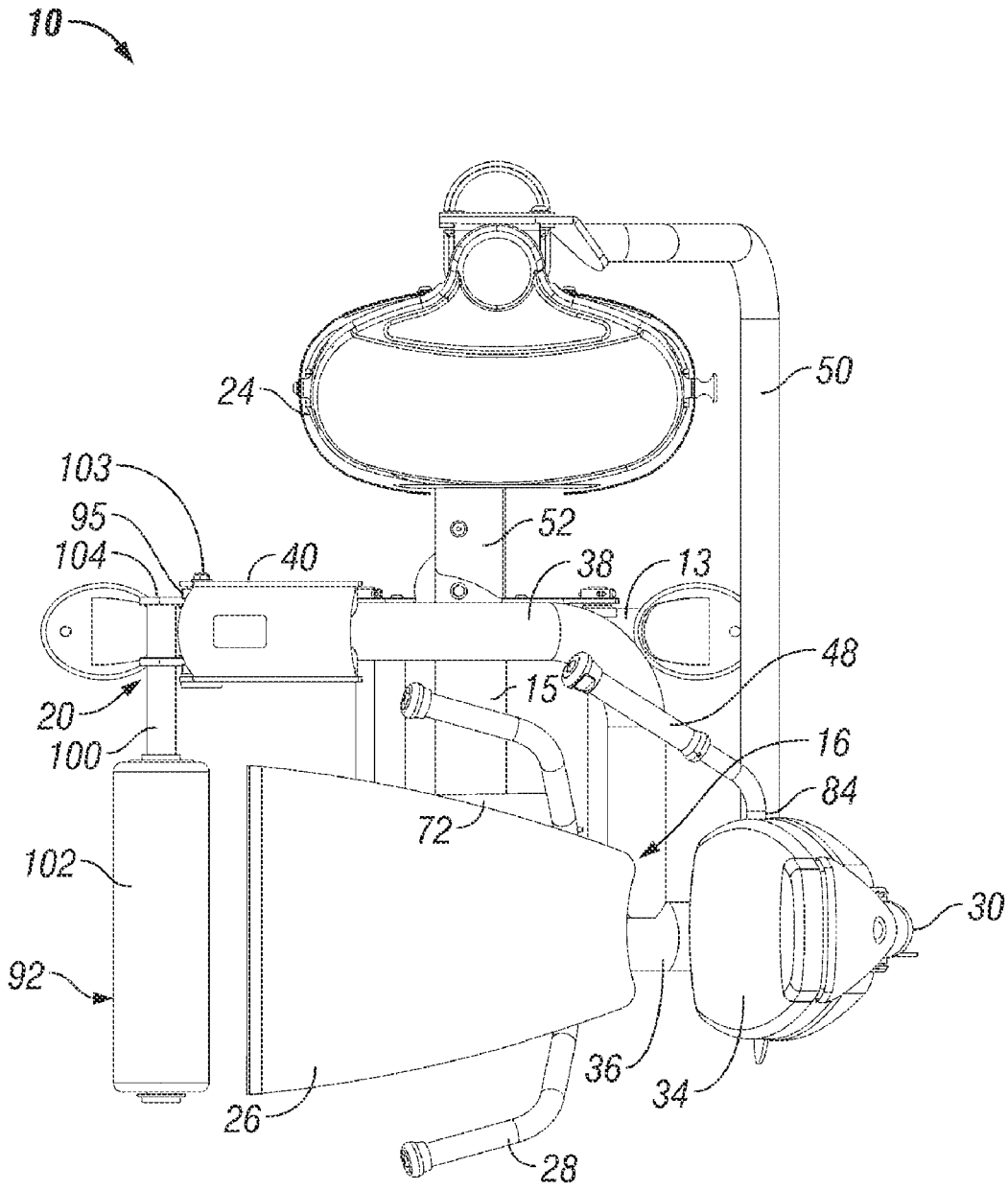
FIG. 4 is a top plan view of the machine of FIGS. 1 to 3.

Main frame 12 has a base section comprising first and second parallel base struts 13, 14 connected by a cross member 15, and a rear inclined upright or post 17 at the rear end of base strut 14. The weight stack frame is connected to the main frame by a connecting rod 50 which is connected to the outer face of the weight stack frame at one end and to the upright 17 at the other end. A cable and pulley linkage guide tube 52 extends from frame 24 to the first base strut 13 of the main frame, as illustrated in FIG. 3. The weight stack frame 24 houses a weight stack 54 running on two guide rods 55.

The user support 16 has a seat frame 25 with a seat pad 26 and support handles 28 fixedly attached to the frame. A back rest support frame 30 is pivotally attached to the rear end of the seat frame 25, and a back pad 34 is mounted in front of frame 30. A range-of-motion (ROM) adjustment device 35 is connected between the seat frame and back rest frame for varying the back rest angle and locking the back rest in the adjusted position, as explained in more detail below. The back rest adjustment allows adjustment of the back supported positioning for various size users. The seat frame 25 has seat support tube 36 and an "L" shaped outrigger tube 38 which extends to one side of the seat. One end of the outrigger tube 38 is attached to the seat support tube 36 at the rear of seat pad 26, as best illustrated in FIG. 1, while the second, outward projecting end has a pivot bracket 40 attached at its end.

The four-bar pivoting linkage system 18 between the main frame and seat frame comprises a first pivot link 60 and a second pivot link 62 each pivoted at one end to the main frame and at the other end to the seat frame. The first pivot link 60 is pivotally attached at one end to the rear upright 17 for rotation about pivot axis 64 and pivotally attached at its second end to the rear end of the seat support tube 36 for rotation about pivot axis 65. As best illustrated in FIGS. 1 and 2, the first pivot link 60 comprises two plates connected together at a central region by shaft 66. At one end, the plates are connected by a pivot pin extending through pivot sleeve 68 secured to the top of upright 17. At the opposite end, the plates are connected by a pivot pin extending through pivot sleeve 70 secured to the rear end of seat support tube 36.

Figure 2:
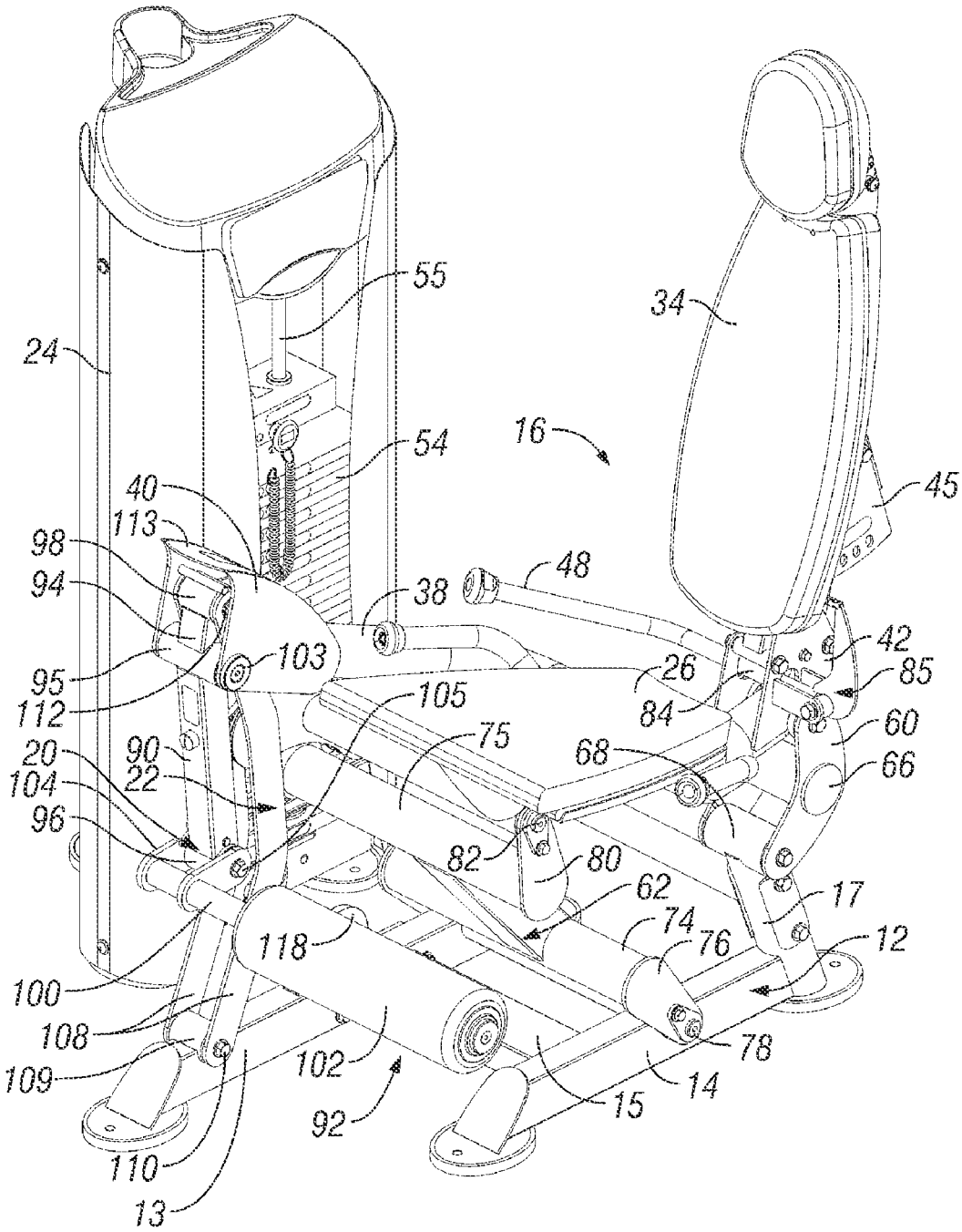
FIG. 2 is a front perspective view of the machine of FIG. 1.

The second pivot link 62 of the four-bar linkage system 18 comprises a center bar 72 extending between two transverse end connectors or tubes 74, 75 in a generally H-configuration, as seen in FIGS. 1 and 2. The first end tube 74 is mounted between a pair of pivot brackets 76 which are pivotally attached between the two base struts 13, 14 for rotation about a first pivot axis 78. The second end tube 75 is mounted between a pair of pivot brackets 80 at its opposite ends which are pivotally connected to the seat support frame at a location adjacent the forward end of the seat pad for rotation about a second pivot axis 82.

The ROM adjuster mechanism between the seat and backrest is described below in more detail, with reference to FIGS. 1, 5 and 6. The back rest frame has a ROM adjuster housing 44 at its lower end. A pair of adjuster brackets 42 extends upwardly from pivot sleeve 70 at the rear end of the seat support tube 36. The back rest frame 30 is pivoted to the adjuster brackets 42 by a four-bar pivot linkage comprising two pivot links 46 each pivoted at one end to a respective adjuster bracket 42 and at the other end to the ROM housing 44, as best illustrated in FIG. 1. A range-of-motion adjuster plate 45 is fixedly attached to one face of the adjuster housing (see FIGS. 1 and 5). An adjustment handle 48 has a bent shaft 84 extending through a hole in one of the adjuster brackets 42 and is pivotally mounted to the other adjuster bracket. The shaft 84 is linked via a pull pin linkage 85 to a pull pin 86 mounted on the same bracket (see FIGS. 2 and 6A). The pull pin 86 engages with an aligned hole in the range-of-motion plate 45 mounted on the adjuster housing 44 to provide positioning adjustment for the back pad to accommodate various size users. Release of the pull pin by pulling up on handle 48 allows the angle of the back rest to be adjusted. The handle is released when the desired orientation is reached, and the pull pin then springs back into an aligned ROM plate opening. A gas-assist return shock device 88 extends between adjuster bracket 42 and the adjuster housing 44 to return the back rest to a forward position when released.

The exercise arm 20 is best illustrated in FIGS. 2, 3, 5 and 6, and comprises a main tube 90, a user engaging device 92 extending to one side of the main tube 90, and a stand-off tube 94 (FIG. 2). The main tube 90 has a first pivot mount or sleeve 95 attached at its first end and a second pivot mount 96 approximate its second end. The stand-off tube 94 is secured to the pivot sleeve 95 on the main tube at one end and has a link connecting pivot mount or sleeve 98 at its second end. The first pivot sleeve 95 is rotatably engaged over a pivot pin extending between opposite sides of the pivot bracket 40 on the end of outrigger tube 38 for rotation about first exercise arm pivot axis 103. The user engaging device 92 comprises a pad mounting tube 100 with a leg engaging roller or pad 102 telescopically mounted over tube 100. A pair of connecting brackets 104 are secured approximate the free end of tube 100 and are pivotally connected to the second pivot mount or sleeve 96 of the main tube 90 for rotation about second exercise arm pivot axis 105. This pivotal connection enables the leg engaging pad 102 to self-align to the user during the exercise and automatically adjust to the user's leg length.

The connecting link 22 comprises a pair of spaced bars 108 (FIG. 2) connected together by connecting bars or tubes. A first end of the connecting link is pivotally attached at or adjacent the front end of the base strut 13 to a link connecting pivot mount 109 for rotation about a first connecting link pivot axis 110. A second end of the connecting link extends into the space between the opposite sides of pivot bracket 40 and is pivotally attached to the link connecting pivot mount or sleeve 98 at the end of exercise arm stand-off 94 for rotation about a second connecting link pivot axis 112. A shield plate or cover 113 extends over pivot bracket or housing 40 to restrict access to the moving parts in the pivot housing and protect the user's fingers.

In this embodiment, the user support is pivotally mounted to the main frame via the user support four-bar linkage pivot system, with the first and second pivoting links connecting the first and second pivot mounts on the main frame and user support respectively. The exercise arm is pivotally connected by its first pivot mount to the pivot bracket 40 mounted on the user support outrigger tube 38. The connecting link 22 pivotally joins to the exercise arm 20 with the main frame via the link connecting pivot mounts 98 and 109.

A cable and pulley system links the weight stack 54 to a cam on the rear of the exercise arm main tube 90. The cable of the cable and pulley system is linked to an anchor 115 on the main tube 90. The cable and pulley system includes a pulley 116 on outrigger tube 38 and a pulley 118 on the base strut 13, respectively. However, different cable and pulley paths may be provided in alternative embodiments.

Figure 5A:
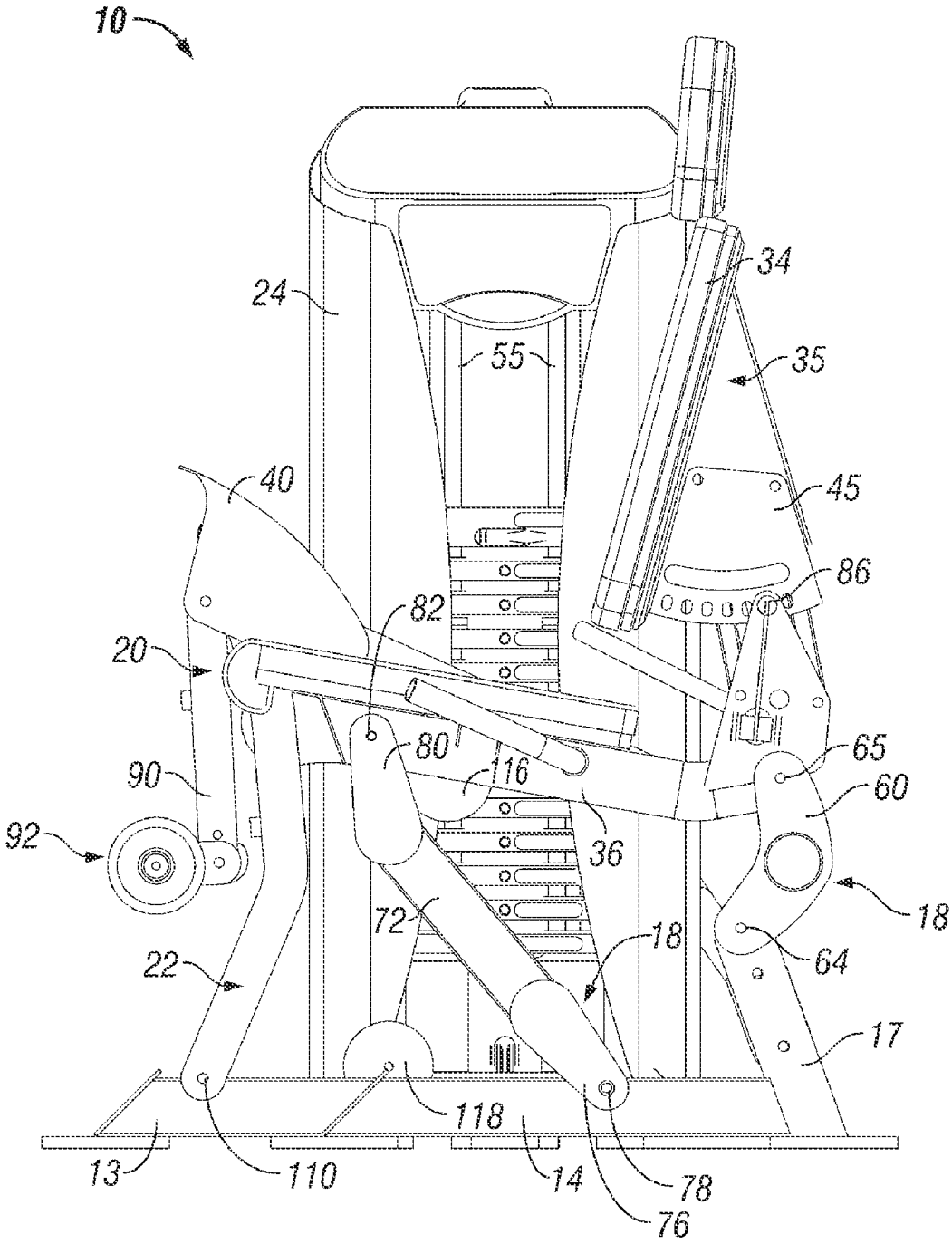
FIG. 5A is a side elevation view of the machine of FIGS. 1 to 4 in a start position for a leg extension exercise.
Figure 6A:
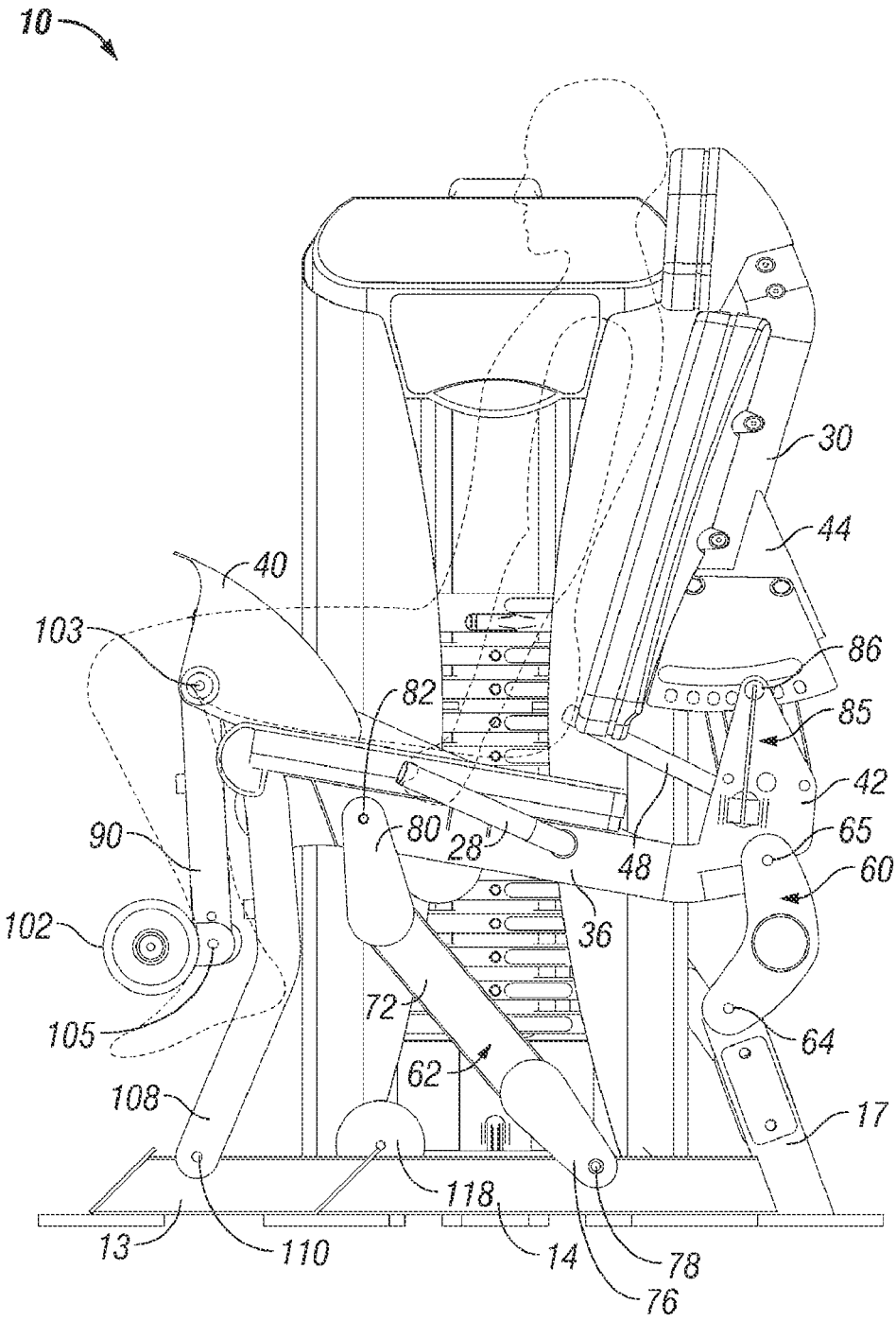
FIGS. 6A and 6B are side elevation views similar to FIGS. 5A and 5B but illustrating a user in position on the machine and performing a leg extension exercise.

FIGS. 5A and 6A illustrate the start position for a leg extension exercise. To perform the exercise the user 120 sits on the seat with their back against the back pad, their knees bent and their feet behind the leg engaging roller 102, as illustrated in FIG. 6A. They may grab the support handles 28 for additional bracing if desired. The user then starts the exercise movement by extending their lower legs outward. This movement causes the exercise arm 20 to pivot about pivot axis 103 at its connection to the user support pivot bracket 40, which simultaneously rotates the stand-off 94 rearward. As the stand-off rotates rearward, it causes the connecting link 22 to rotate rearward as well, as it pivots about its connection to both the exercise arm and the main frame at pivot axes 112 and 110, respectively. This in turn forces the user support to rotate, tilting it rearward about the user support four-bar pivoting linkage system 18, so that the rear end of the set pad rotates down and the front end rotates up. This means that the hips of a user seated on seat pad 26 drop down while their knees move up.

Figure 5B:
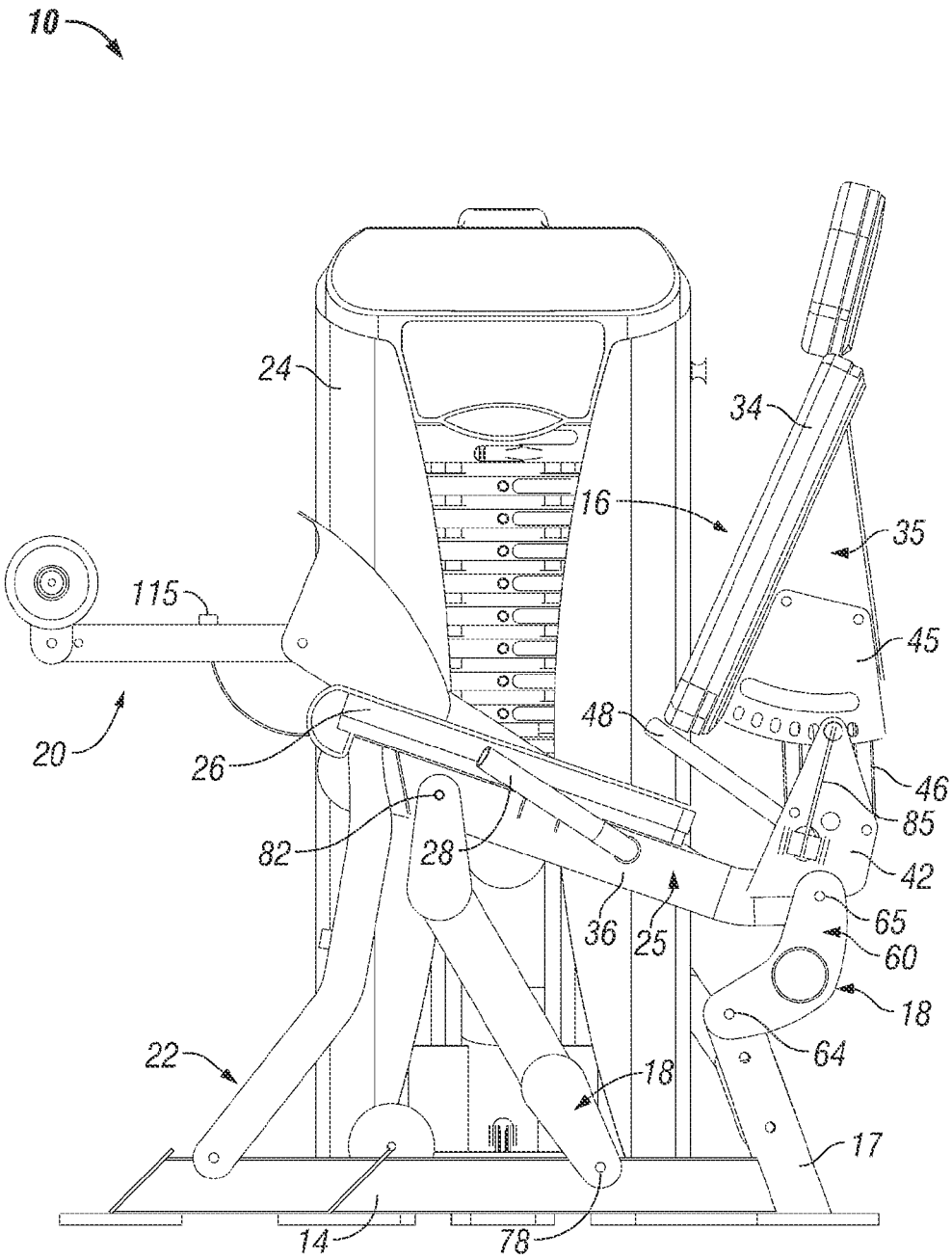
FIG. 5B is a side elevation view of the machine of FIGS. 1 to 4 in a finish position for a leg extension exercise.
Figure 6B:
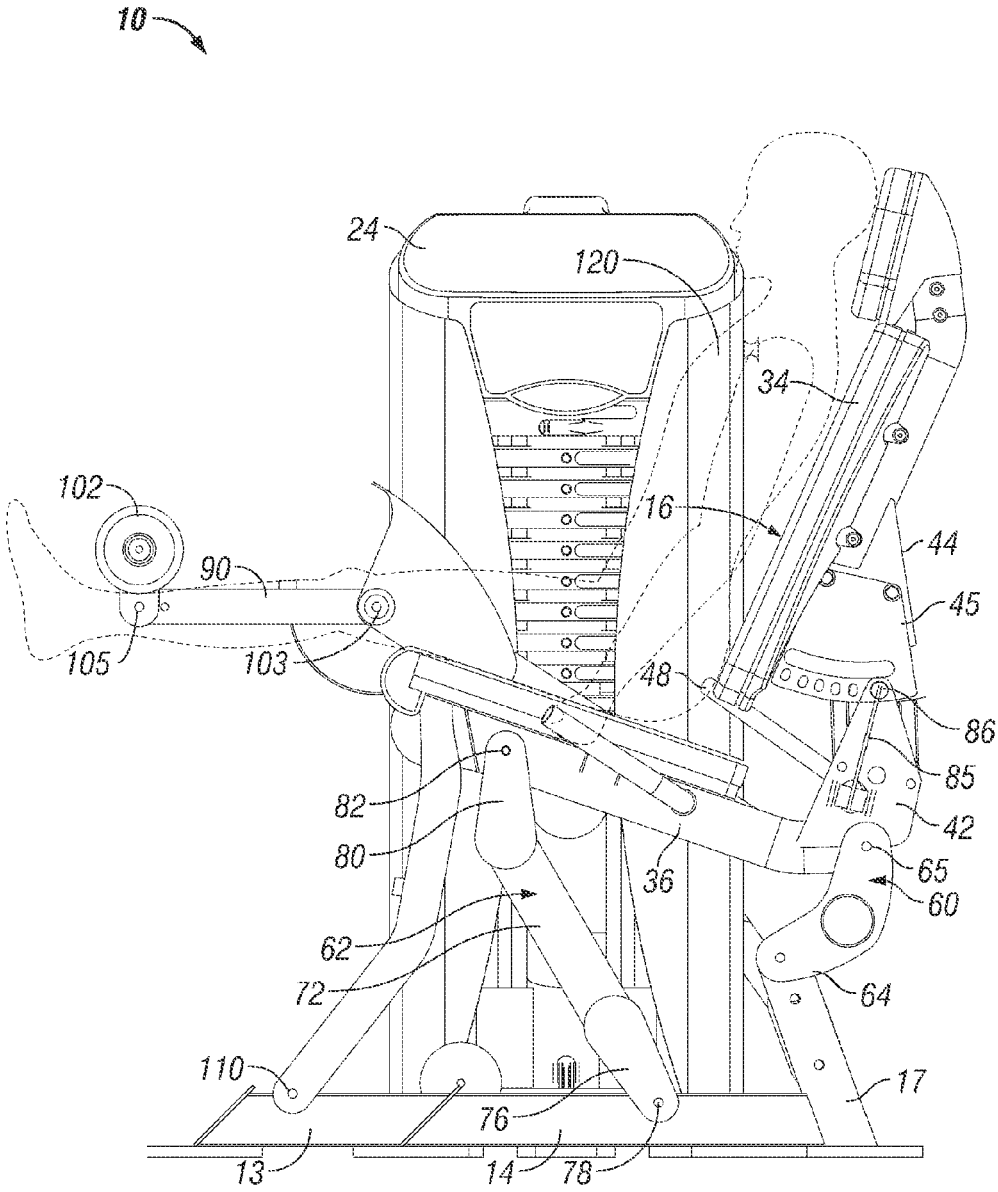

The four-bar pivoting linkage system is designed to control the upward and rearward movement of the user support seat and to reorient the seat from a relatively flat position to an angled finish position as illustrated in FIGS. 5B and 6B. By using the four-bar linkage as the user support pivot system, all the pivoting action can take place under the user with the pivot mounts conveniently located on the main frame and user support. However, the theoretical pivot or combined pivot point of the four-bar linkage system is actually located elsewhere. The theoretical pivot is the point where a single pivot would have to be located in order to mimic the same user support movement pattern achieved by the four-bar pivoting linkage.

Figure 7:
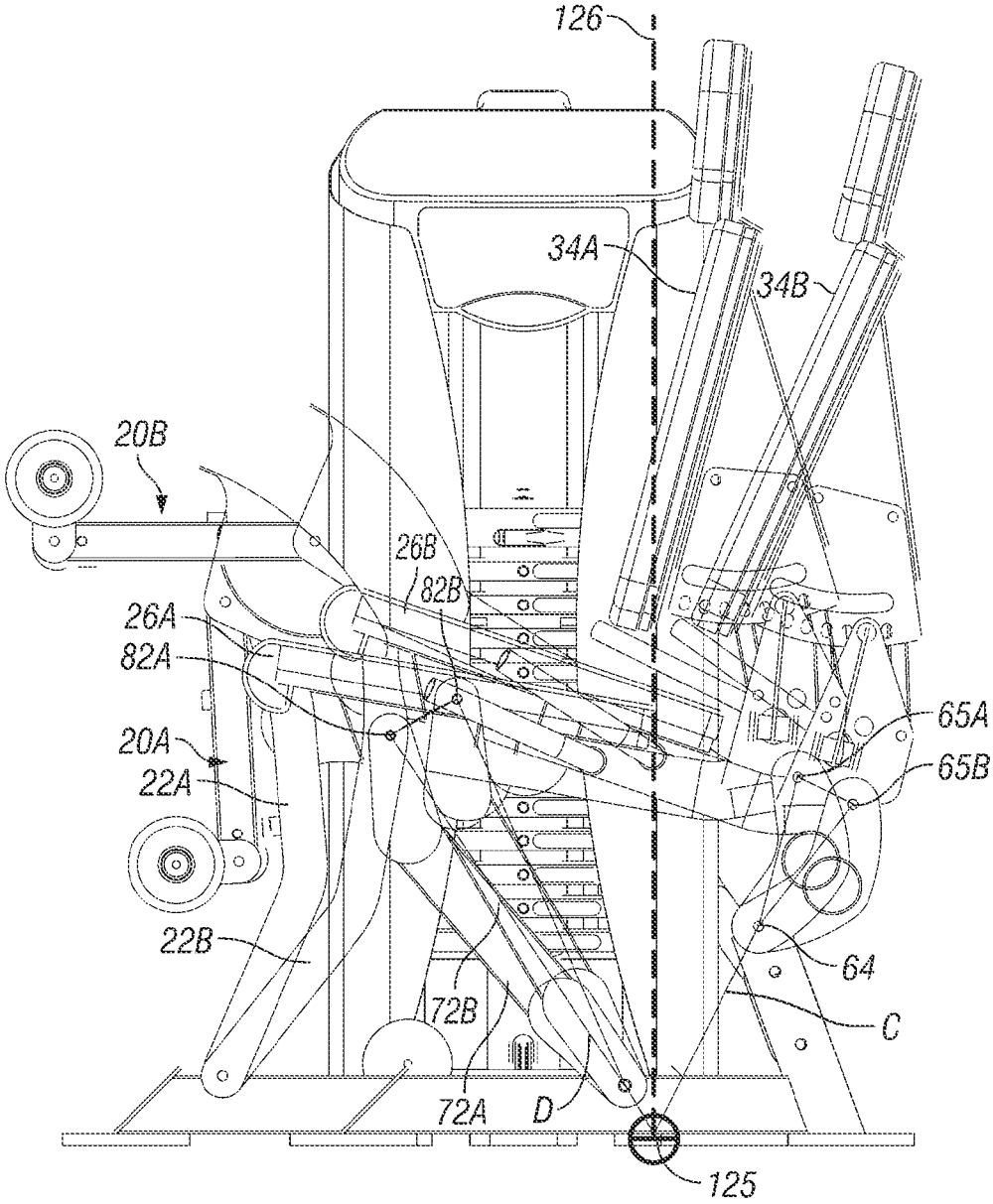
FIG. 7 is a side elevation view of the machine of FIGS. 1 to 6 with the start and finish positions of the machine superimposed.

FIG. 7 illustrates the location of the theoretical pivot 125 of the four-bar pivoting linkage system 18. In FIG. 7, the start and finish positions of the exercise machine moving parts are superimposed, with the letter A following the reference number being the start position and the letter B following the reference number for a part being the finish position. FIG. 7 illustrates the plotting of the theoretical pivot point for the user support. The centerline C, D of the arcing movement of each of the pivot links 60, 62 is plotted (line from the midpoint of the line connecting the start and end pivot axis position through the fixed pivot axis on the base support of the main frame) and the point in space where the two centerlines intersect is the theoretical pivot point 125. Vertically bisecting this point produces the gravitational centerline 126 of the user support movement.

The advantage of the four-bar pivot system with the theoretical pivot is that it duplicates the movement pattern of a single point pivot that might normally be located in an area impossible to access due to either structural or user interference, so that a desired movement pattern may be achieved while keeping the moving parts of the pivot mount beneath the user support. The combined exercise arm and user support movement illustrated in FIGS. 5A, 5B, 6A, 6B and 7 may not be possible with a single pivot.

The leg extension exercise machine 10 has a relatively flat seat in the starting position of FIGS. 5A and 6A, and the starting seat height is relatively low to the ground to make entering, position adjustment and exiting easier. As soon as the exercise arm is engaged, the seat starts to recline to maintain the beginning pre-stretch and continues to recline as the leg exercise arm 20 arm is extended upward and the user straightens their legs. The finishing position is not severely angled so that the user can achieve a full extension to their legs. Because the seat angle starts out relatively flat and gradually reclines, there is little or no undue stress placed on the knee during the exercise.

The pivoting action of the seat drops the user's hips while it raises their knees, and the user tends to stay firmly planted in the user support. There is no need for any extra hold down support because there is little or no teeter-totter effect with the hips trying to lift up off the seat. Instead, the pivoting seat is continuously moving the user hips in the opposite or downward direction from the legs. In this isolation exercise machine, the pivoting joint of the user (in this case the user's knee) is substantially aligned with pivot axis 103 of the leg exercise arm throughout the exercise, as seen in FIGS. 6A and 6B.

The combined exercise arm and user support movement of the isolation leg extension exercise machine is made possible by the four-bar pivoting linkage system 18, which duplicates the movement pattern of a single point pivot that would otherwise be located underground, beneath the machine, as illustrated in FIG. 7.

Figure 8:
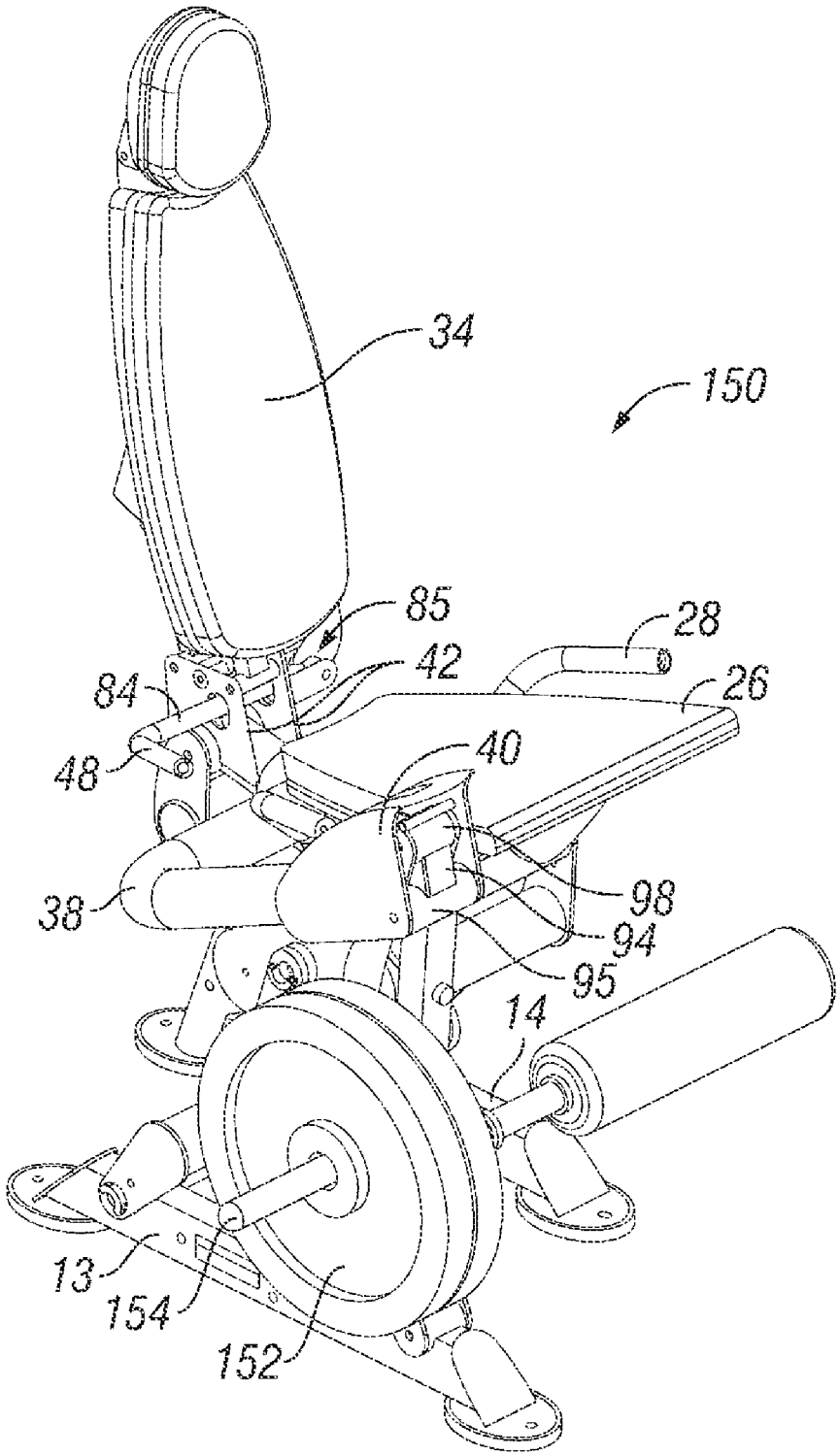
FIG. 8 is a front perspective view of a leg extension exercise machine according to another embodiment.
Figure 9:
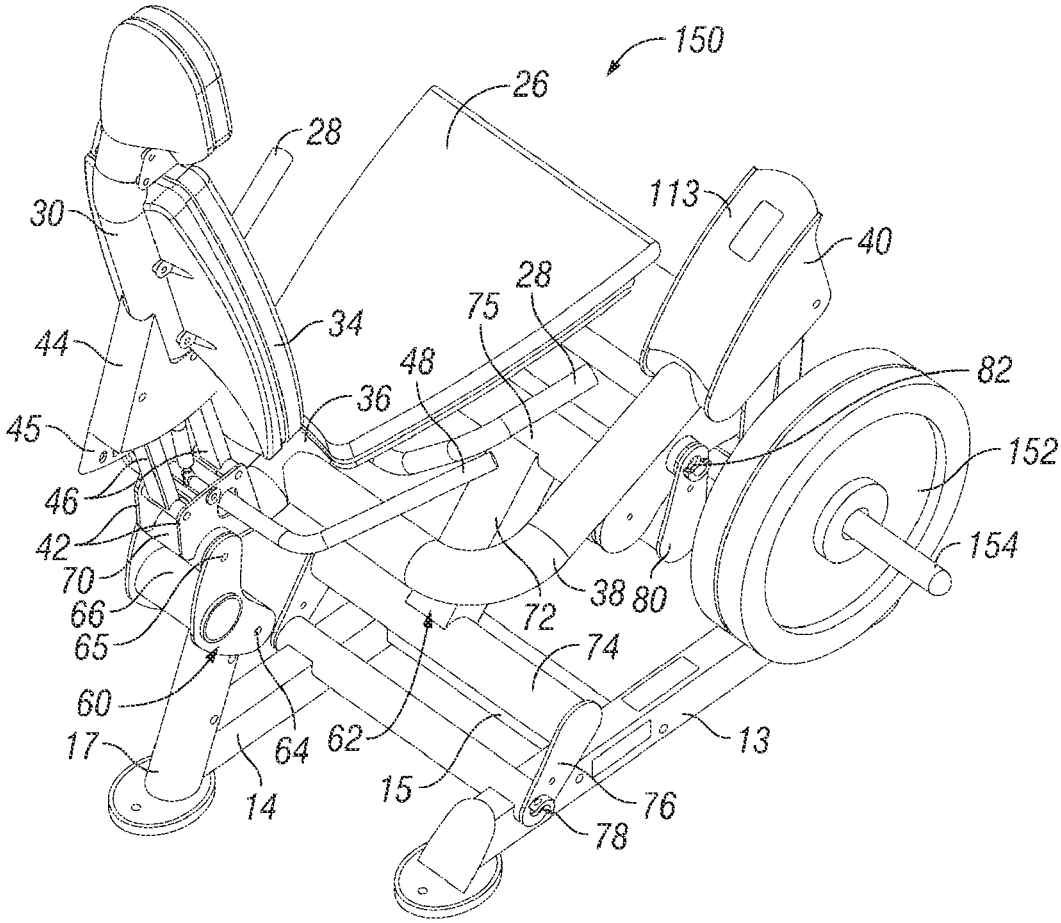
FIG. 9 is a rear perspective view of the machine of FIG. 8.
Figure 10:
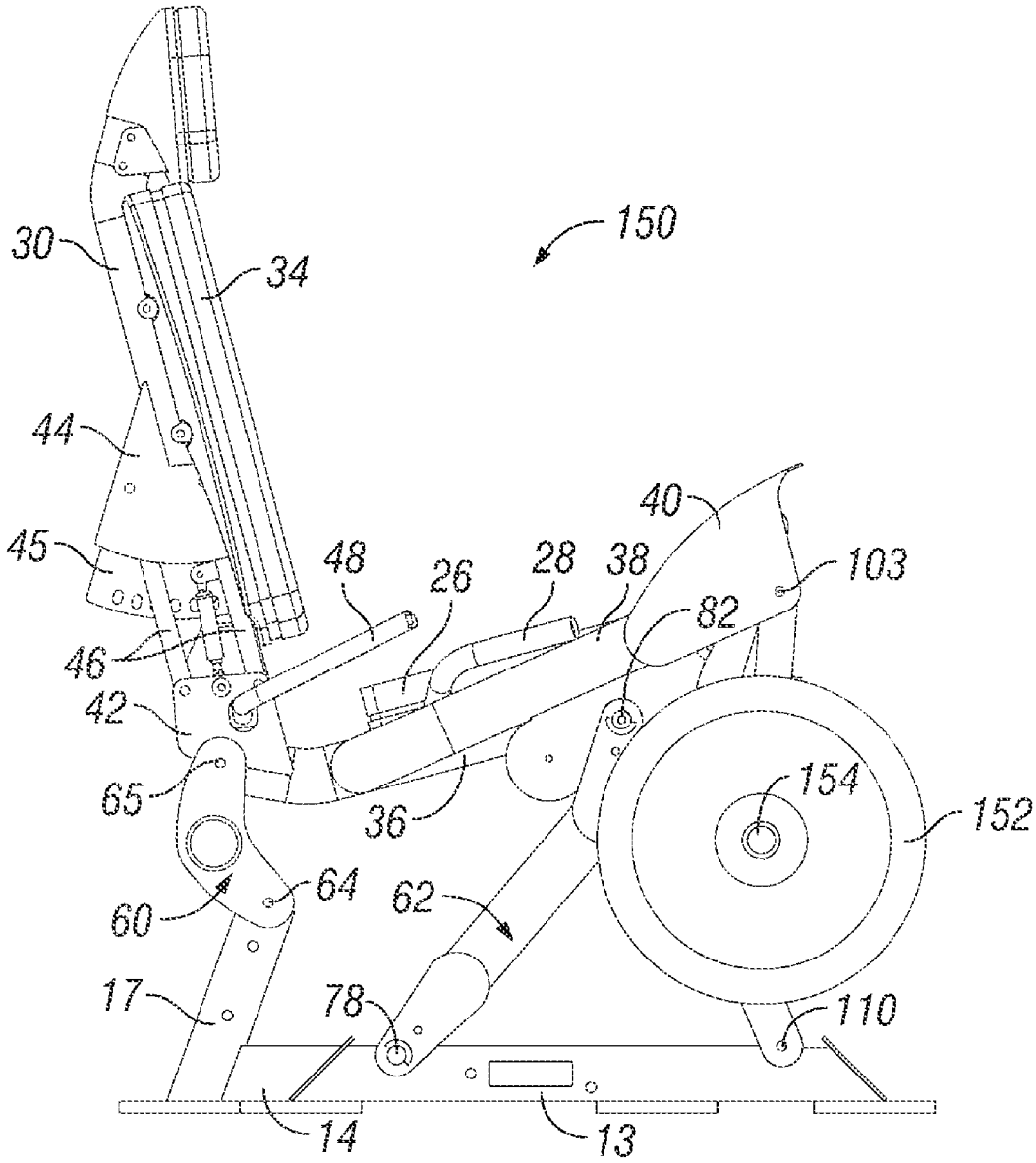
FIG. 10 is a right side elevation view of the machine of FIGS. 8 and 9, illustrating a start position for a leg extension exercise.
Figure 11:
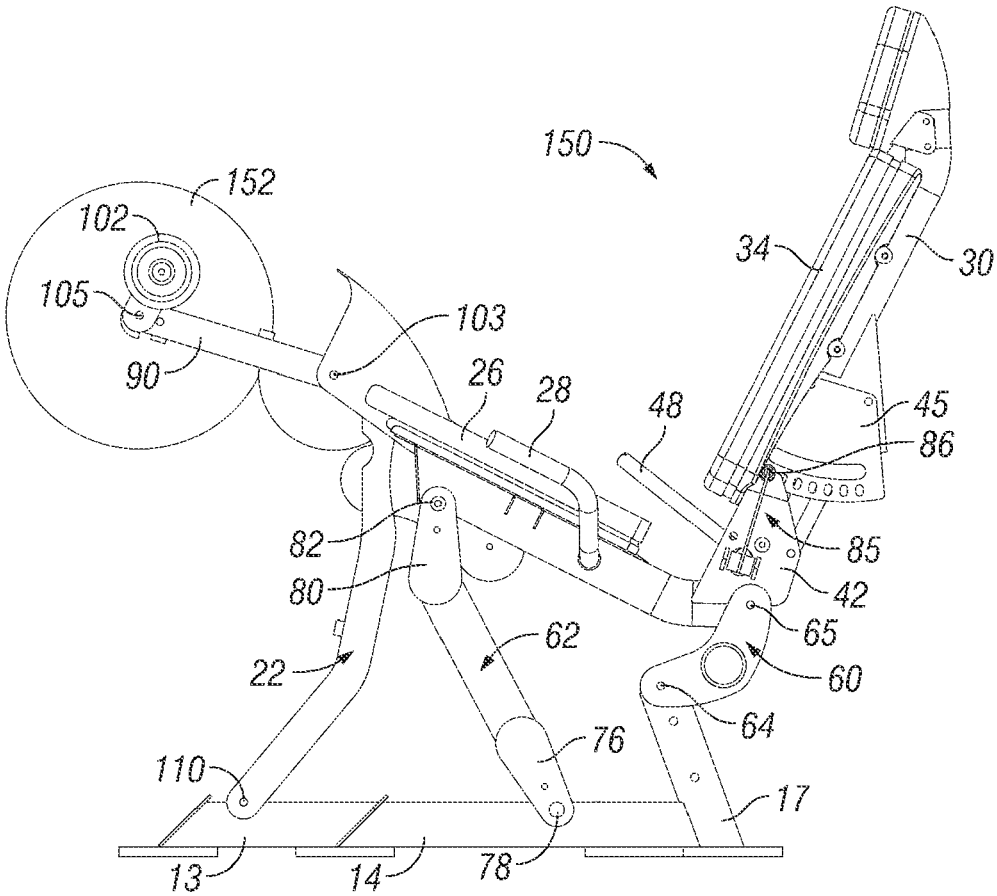
FIG. 11 is a left side elevation view of the machine of FIGS. 8 to 10, illustrating a finish position for a leg extension exercise.
Figure 12:
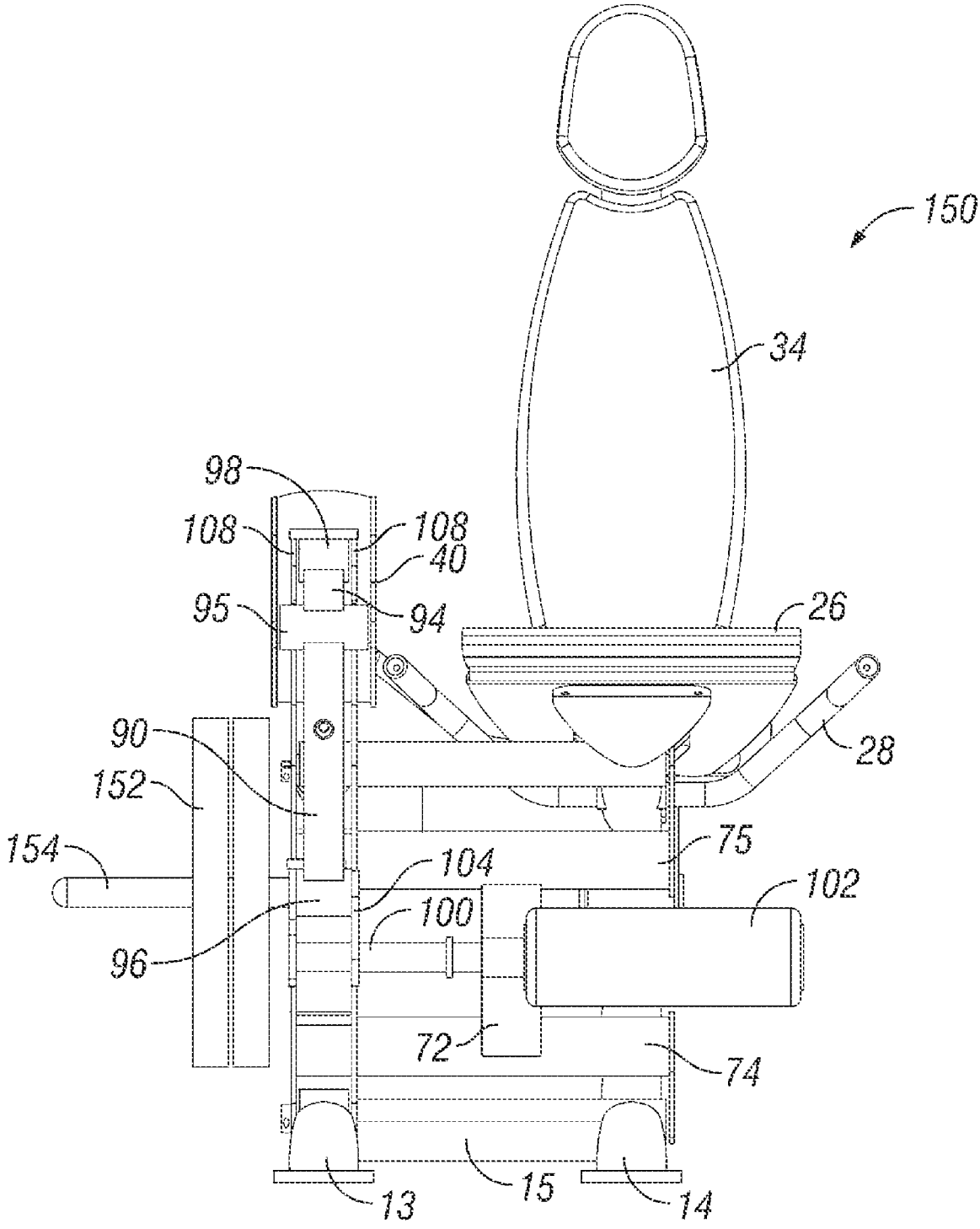
FIG. 12 is a front elevation view of the machine of FIGS. 8 to 11.
Figure 13:
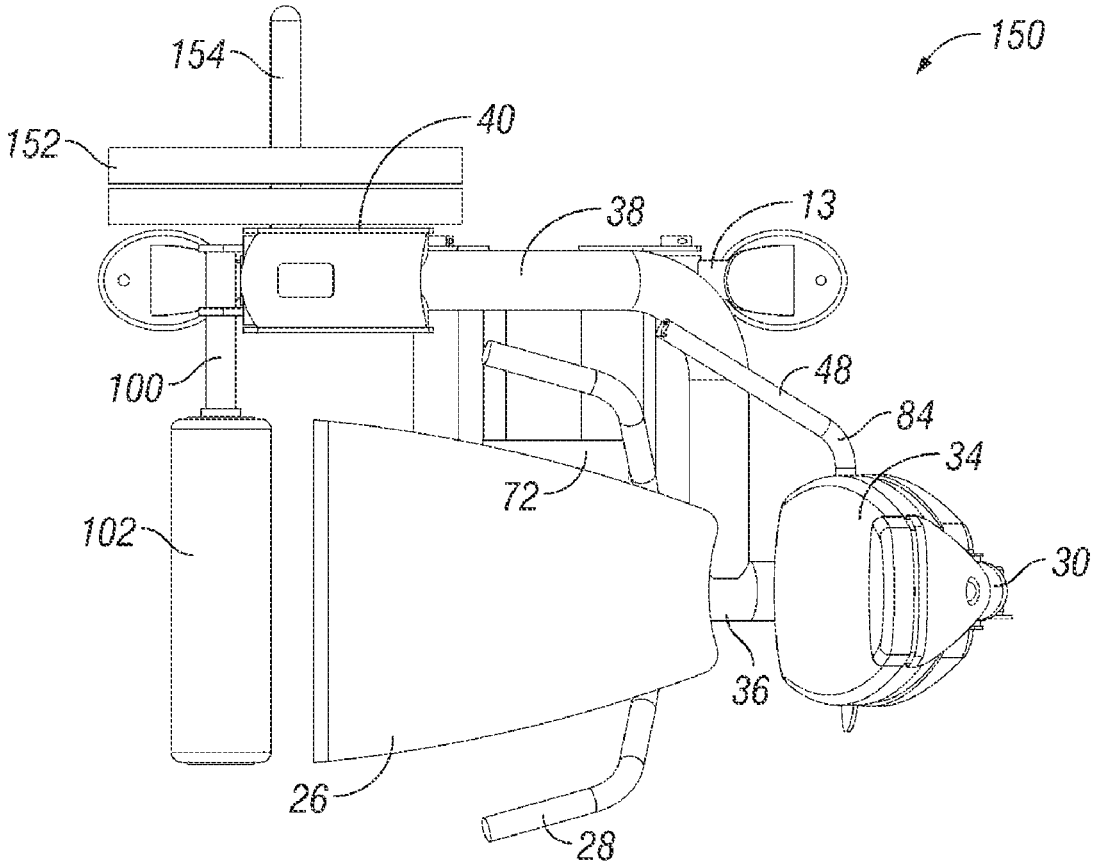
FIG. 13 is a top plan view of the machine of FIGS. 8 to 12.
Figure 14:
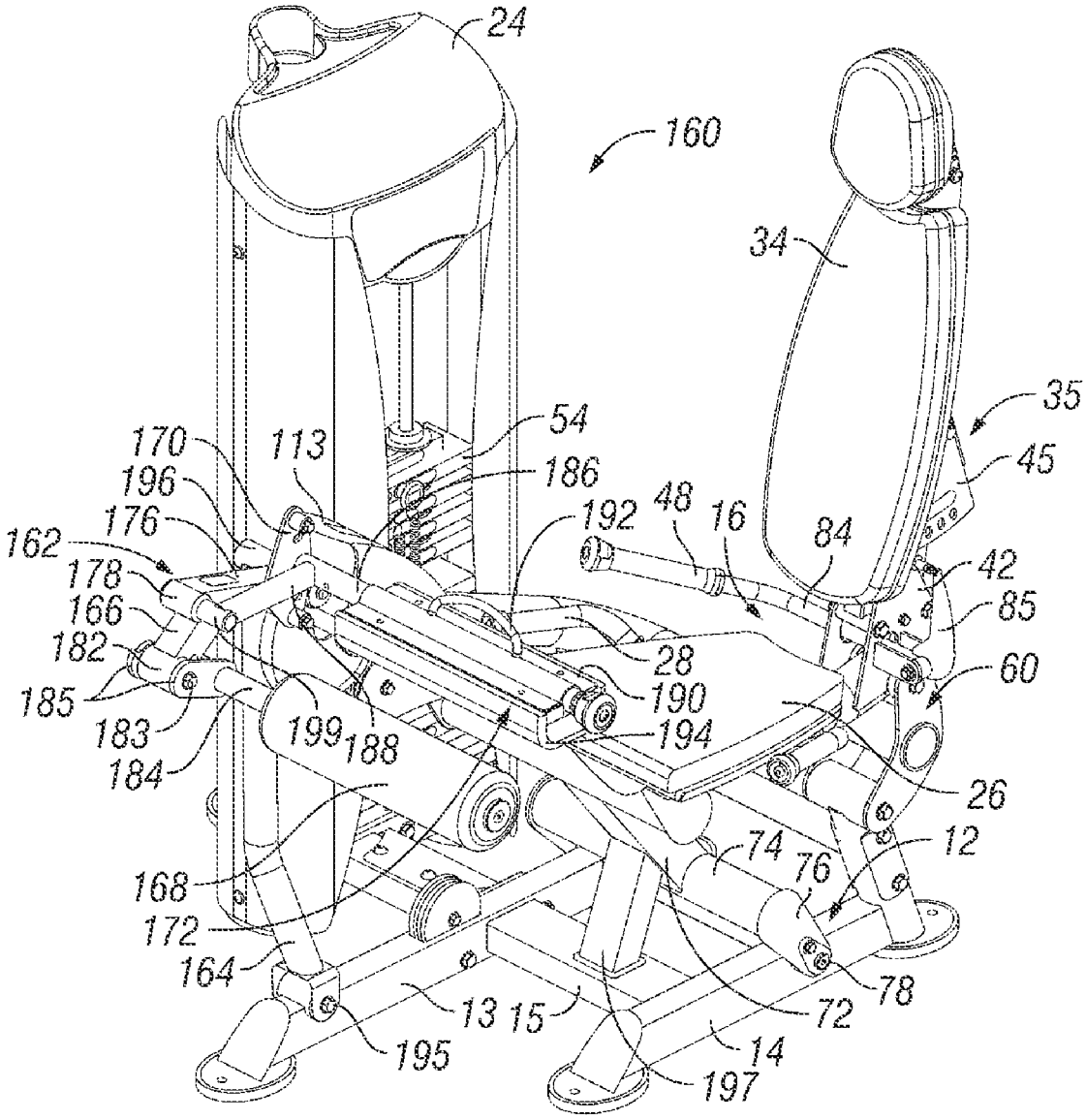
FIG. 14 is a front perspective view of a first embodiment of a leg curl exercise machine.
Figure 15:
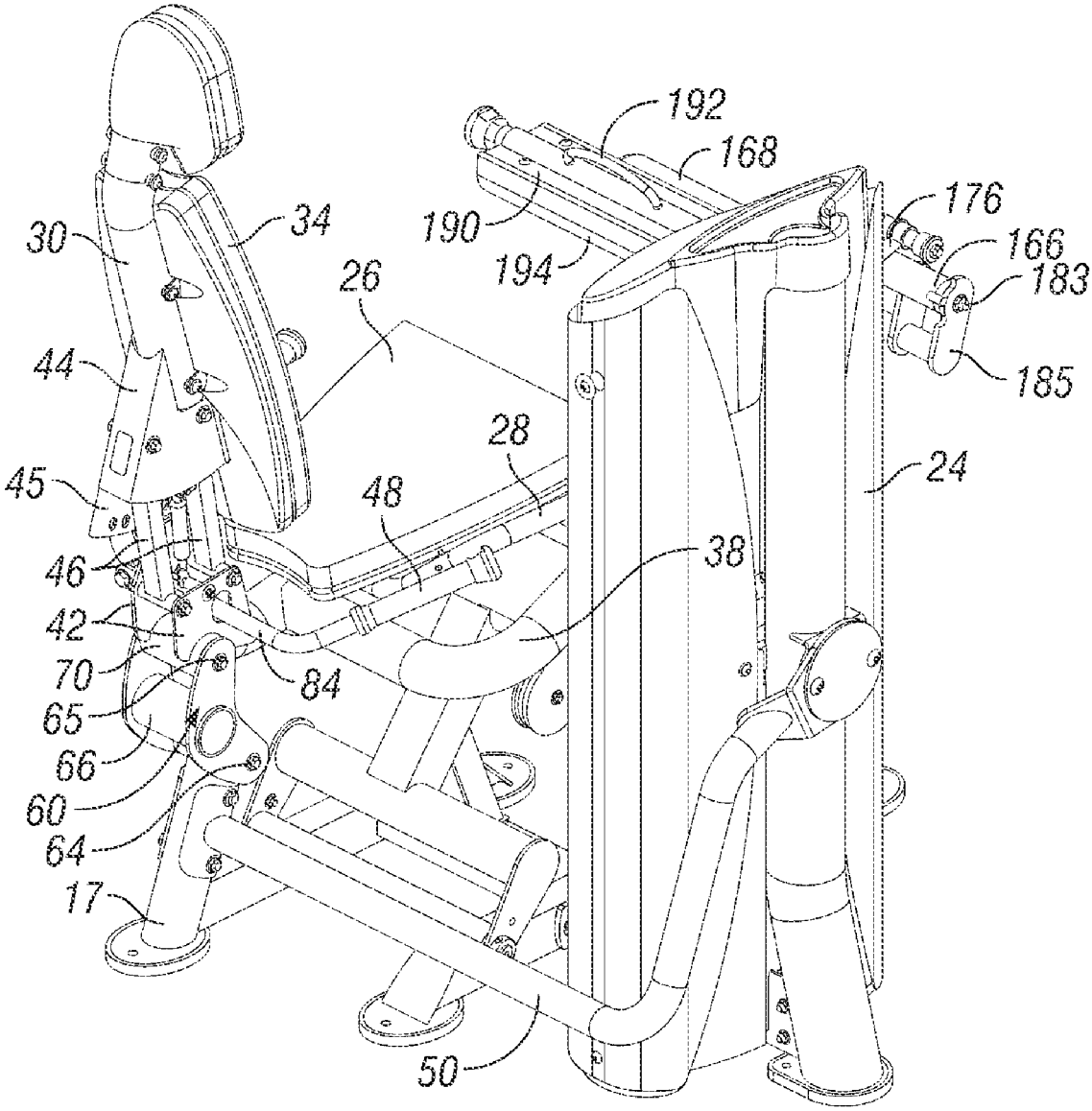
FIG. 15 is a rear perspective view of the machine of FIG. 14.
Figure 16:
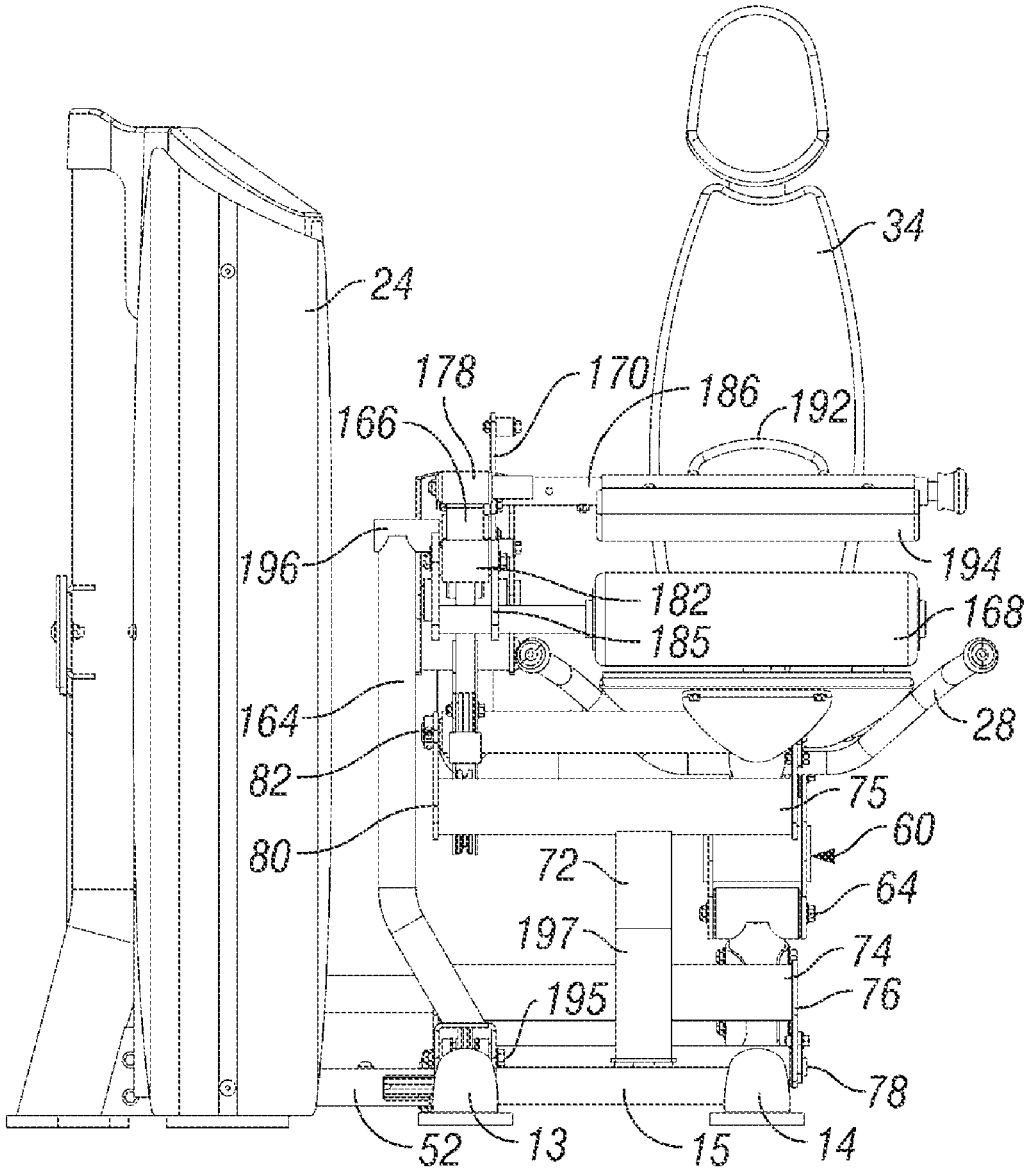
FIG. 16 is a front elevation view of the machine of FIGS. 14 and 15.
Figure 17:
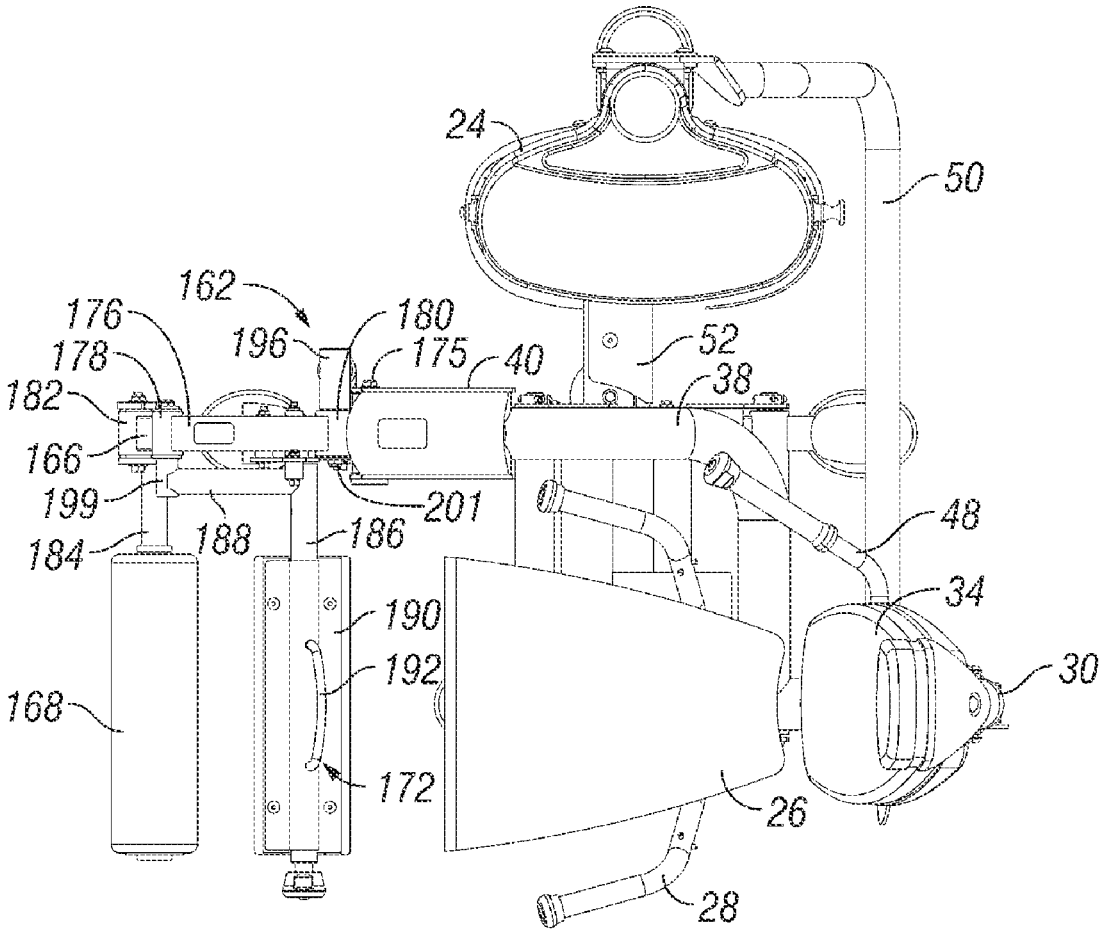
FIG. 17 is a top plan view of the machine of FIGS. 14 to 16.

FIGS. 8 to 13 illustrate a leg extension exercise machine 150 according to a second embodiment. This machine is similar in most aspects to the machine of FIGS. 1 to 7, and like reference numbers are used for like parts as appropriate. However, machine 150 uses hand loaded plates 152 to supply the resistive load to the exercise arm 20, instead of a weight stack as in the previous embodiment. In this embodiment, the cam attached to the exercise arm for attaching the load transferring cable in the previous embodiment has been removed and in its place a weight receiving peg 154 is mounted at the lower end of the exercise arm. This peg extends outboard from the machine and allows the user to selectively add or remove weight plates 152 to achieve the desired load. The leg extension exercise machine 150 of FIGS. 8 to 13 operates in exactly the same way and has an equivalent exercise start position to the previous embodiment, as illustrated in FIGS. 8 to 10, and an equivalent exercise finish position as illustrated in FIG. 11.

FIGS. 14 to 20 illustrate a leg curl exercise machine 160 according to another embodiment. Machine 160 is similar in many respects to the leg extension machine 10 of the first embodiment, particularly the main frame, user support, and four-bar pivoting linkage system by which the user support is mounted on the main frame, and like reference numbers have been used for like parts as appropriate. The main difference between the machine 160 and leg extension machine 10 of the first embodiment is the design of the user engaging exercise arm 162 which is modified to enable the user to carry out leg curl exercises in which the leg starts in a substantially straight position (FIG. 19A) and then rotates down about the knee joint to a bent finish position (FIG. 19B). The exercise resistance in this machine must therefore be connected to provide resistance to arm movement in the opposite direction from that of the previous two embodiments, as explained in more detail below. Additionally, the connecting link 164 of machine 160 is a single tube as opposed to a pair of spaced bars as in the previous embodiments.

Machine 160 comprises a main frame 12, a user support 16 pivotally mounted on the frame by a four-bar pivoting linkage system 18, a leg exercise arm assembly 162 pivotally secured to the seat section of the user support, a connecting link 164 which links movement of the exercise arm to movement of the user support, and a weight stack frame 24 positioned to one side of the main frame. The parts of machine 160 which are identical to those in the first embodiment are not described again in detail, and reference may be made to the description above of FIGS. 1 to 7 for an explanation of these parts.

As seen in FIG. 18, the leg exercise arm assembly 162 comprises a first leg 174 and a second leg 176, a stand-off tube 166 secured to the second leg 176 of the main tube, a user engaging roller 168 secured to one side of the stand-off tube 166, a range-of-motion adjuster plate 170, and a hold down support 172. The first leg 174 of the main tube is pivotally attached at one end to the pivot bracket 40 at the end of outrigger tube 38 of the seat support frame for rotation about a first exercise arm pivot axis 175 (FIG. 18). The second leg 176 has a second pivot mount 178 at its second end and a link connecting pivot mount 180 is located at the web or connection point of the first and second legs of the L-shaped main tube (see FIG. 17). The stand-off tube 166 is secured to the second leg 176 near the location of second pivot mount 178 at one end, and has a user engaging pivot mount 182 at its second end. A user engaging roller or pad mounting tube 184 is pivotally connected to pivot mount 182 for rotation about second exercise arm pivot axis 183 via a pair of connecting brackets 185 secured to one end of the tube, so that the tube extends transversely to one side of the main tube. The leg engaging roller or pad 168 is telescopically mounted on mounting tube 184. This connection enables the user engaging roller to self-align to the user during the exercise and automatically adjust to the user's leg length.

The range-of-motion adjuster plate 170 is mounted to a side face of the second leg 176 of the main tube. The hold down support 172 comprises an "L" shaped tube with a longer first leg 186 and a shorter second leg 188. A mounting plate 190 and handle 192 are mounted on the long leg 186 of the hold down support. A pull pin (not visible in the drawings) is telescopically engaged inside the long leg 186 of the hold down support and engages with positioning holes in the range-of-motion plate 170 mounted on the main tube. A user engaging pad 194 is mounted on mounting plate 190 and provides bracing against the downward force applied to the leg engaging roller 168 during a curl exercise. In order to adjust the height of the hold down support, the user grabs the handle 192, pulls the pull pin out of the aligned hole in ROM plate 170, lifts or lowers the hold down support to the desired position and releases the pull pin, which snaps back into the aligned opening. A pivot shaft 199 is transversely attached to the end of the shorter leg 188 of the L-shaped tube and is pivotally connected to the second pivot mount 178 of the main tube.

The connecting link 164 comprises a single tube which is pivotally attached at its first end to the base support tube 13 for rotation about a first connecting link pivot axis 195 and has a pivot pin 196 at its second end which is pivotally attached to link connecting pivot mount 180 for rotation about a second connecting link pivot axis 201.

In machine 160, as in the first and second embodiments, the user support 16 is pivotally mounted to the main frame via the user support pivot system 18, with the first and second pivoting links 60, 62 pivotally connected at opposite ends to the main frame and user support respectively. In this embodiment, the center bar 72 of the second pivoting link of the four-bar pivot system 18 has an inclined stand-off or stop post 197 designed to engage the main frame cross bar 15 when the machine is in the rest or exercise start position, as illustrated in FIGS. 14, 16, 18A and 19A.

Exercise arm 162 is pivotally mounted on the pivot bracket 40 mounted on the outrigger tube 38 for rotation about first exercise arm pivot axis 175. A cable and pulley system connects the weight stack via a cable (not visible in the drawings) to a cam 198 mounted on the exercise arm in order to provide resistance to movement of the arm by the user. The cable connection is such that the cable is pulled by rotation of the exercise arm assembly 162 in a counter-clockwise direction when performing the leg curl exercise.

Figure 18A:
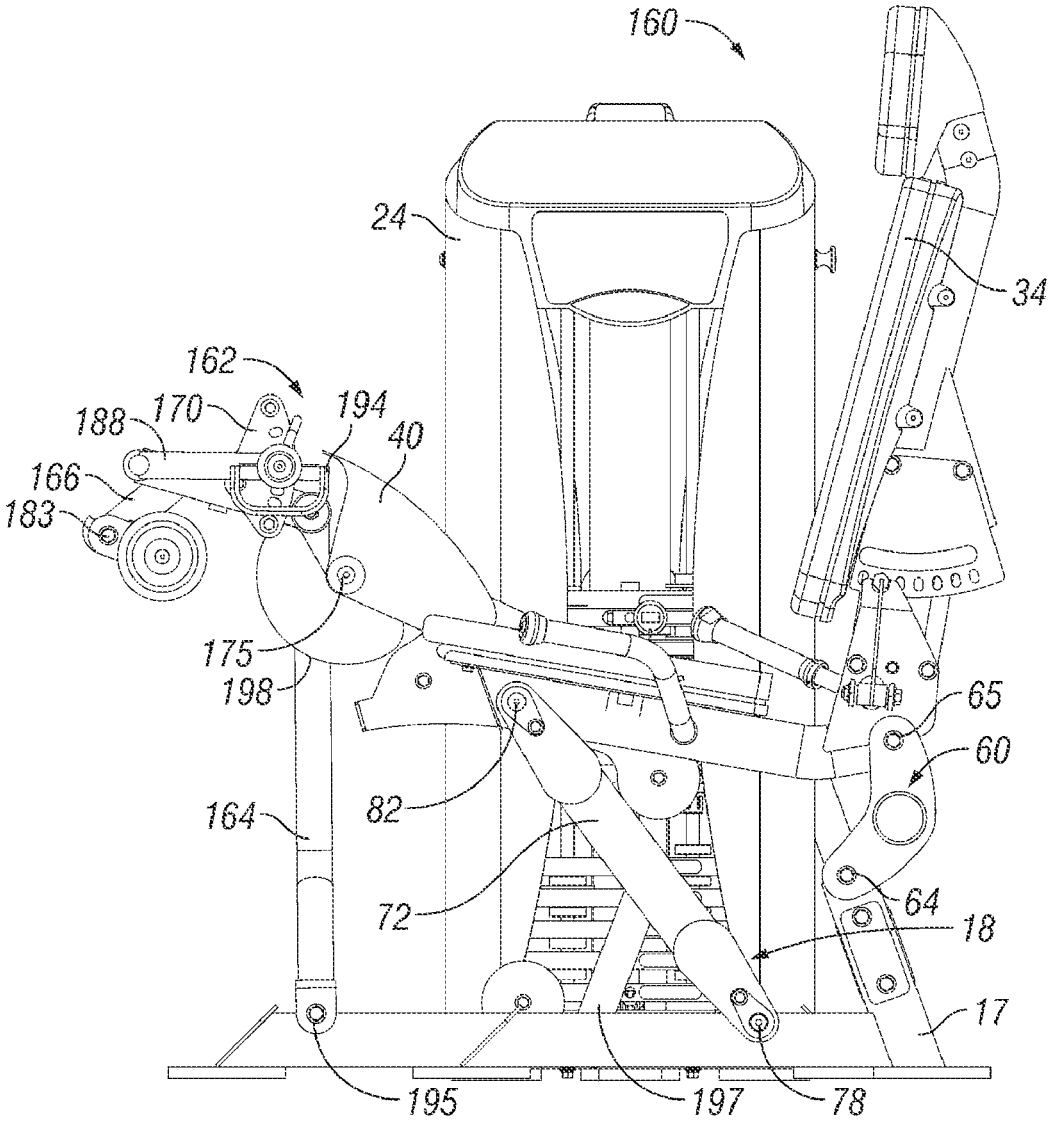
FIG. 18A is a side elevation view of the machine of FIGS. 14 to 17 in a start position for a leg curl exercise.
Figure 18B:
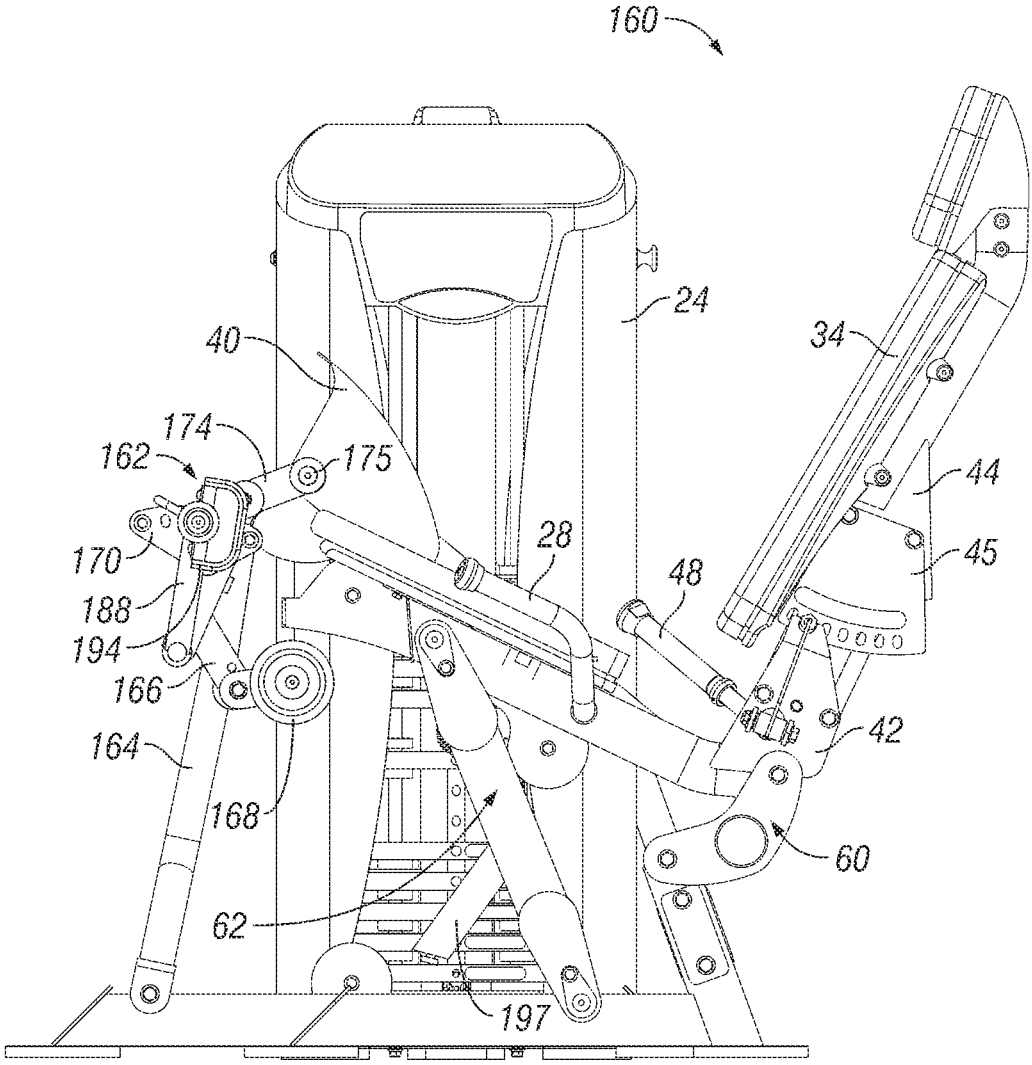
FIG. 18B is a side elevation view of the machine of FIGS. 14 to 17 in a finish position for a leg curl exercise.
Figure 19A:
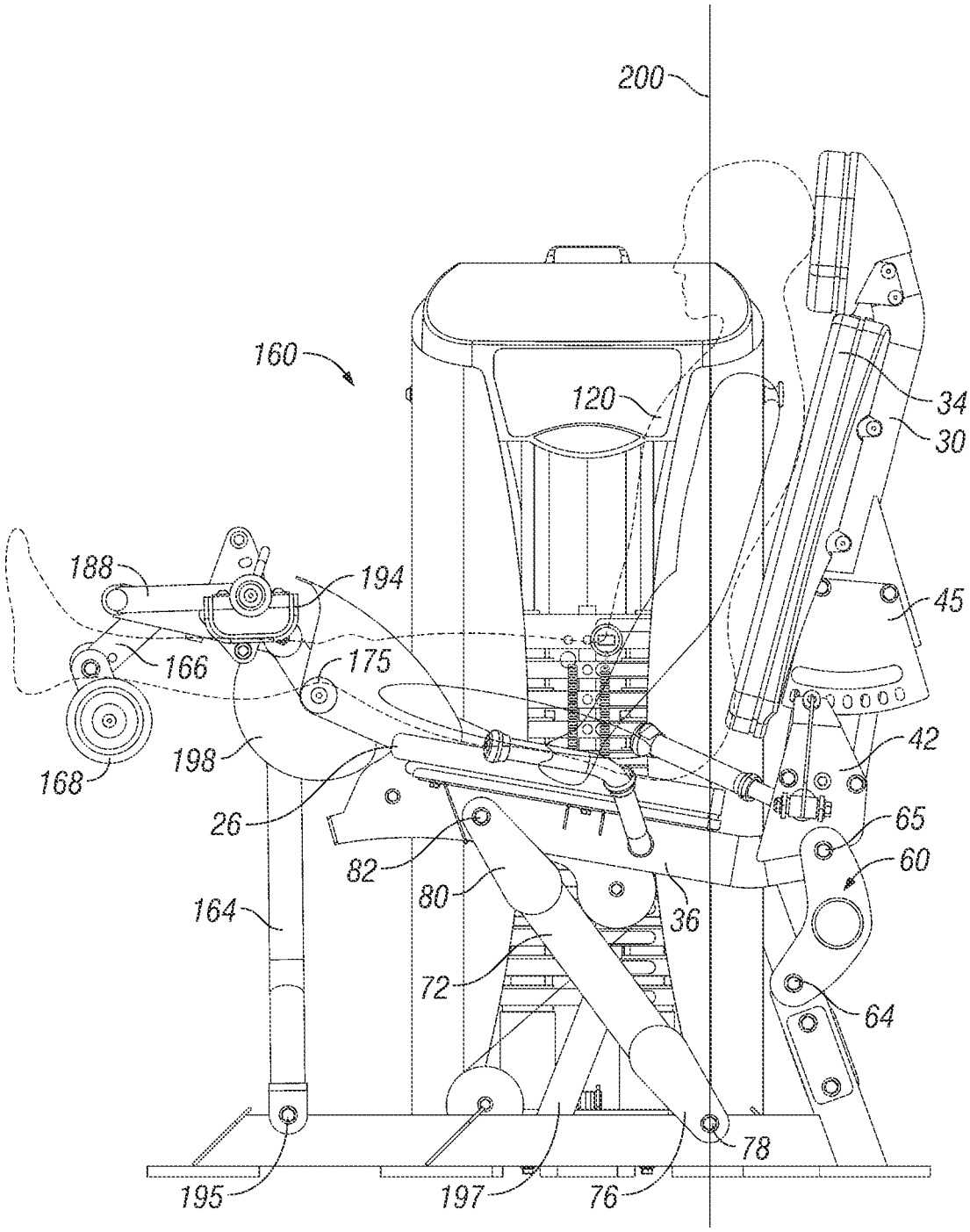
FIGS. 19A and 19B are side elevation views similar to FIGS. 18A and 18B but illustrating a user in position on the machine and performing a leg curl exercise.
Figure 19B:
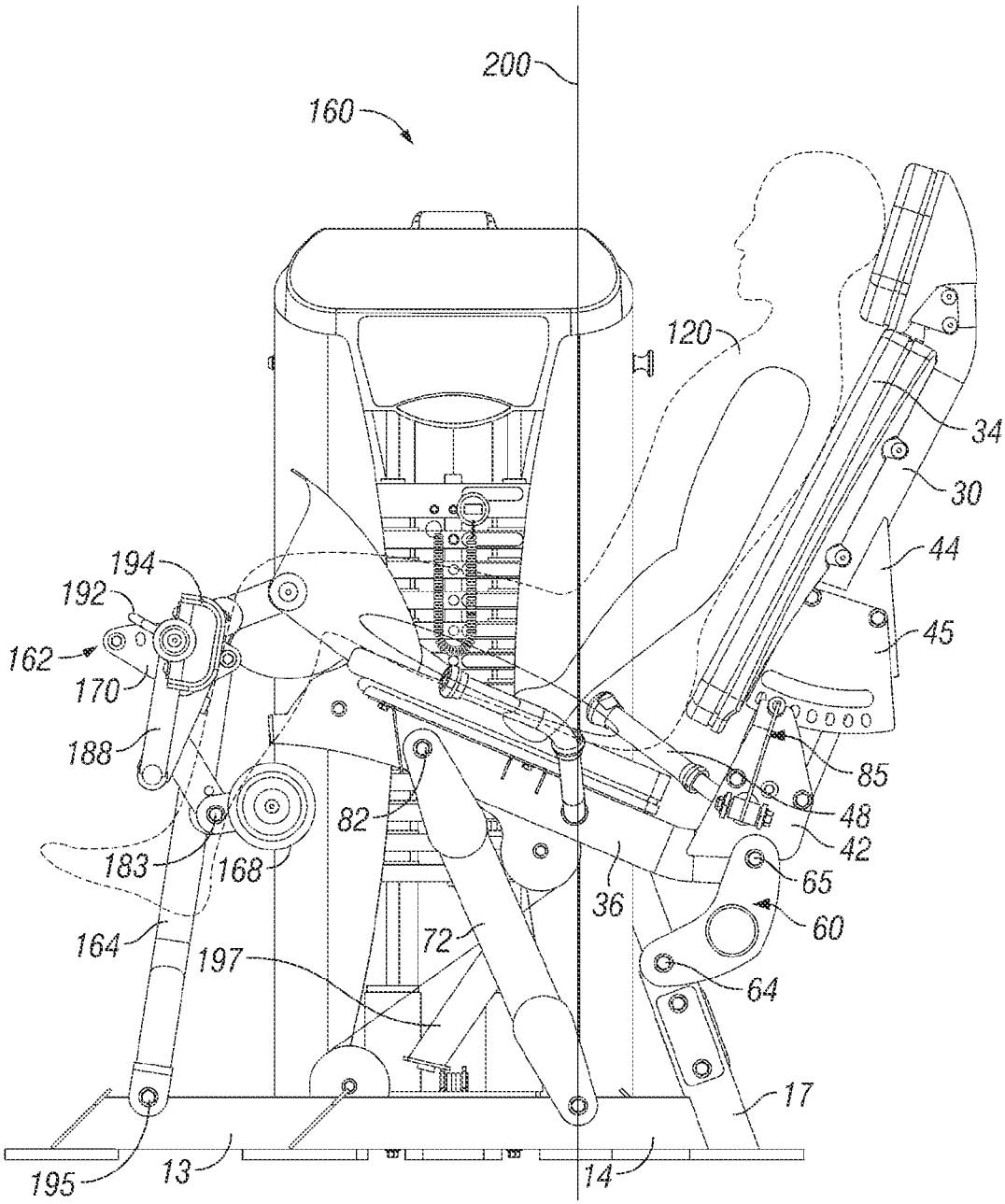

FIGS. 18A and 18B illustrate the start and finish positions for a leg curl exercise performed on the leg curl machine 160, while FIGS. 19A and 19B illustrate the same positions with an exerciser 120 in position on the user support. To perform the exercise the user 120 sits on the seat pad 26 with their back against the back pad 34, their legs extended outward, feet on top of the leg engaging roller 168 and the hold down support pad 194 adjusted down on top of their upper shins. They may grab the support handles 28 for additional bracing if desired. They then start the exercise movement by curling their lower legs downward. This movement causes the exercise arm assembly 162 to pivot about axis 175 at its connection to the user support. This causes the connecting link 164 to rotate rearward as it pivots about its connection to both the exercise arm and the main frame. This in turn forces the user support to rotate, tilting it rearward about the four-bar pivoting linkage system 18 which is designed to control the upward and rearward movement of the user support seat and reorient the seat from a relatively flat position to an angled position, as in the previous two embodiments.

Figure 20:
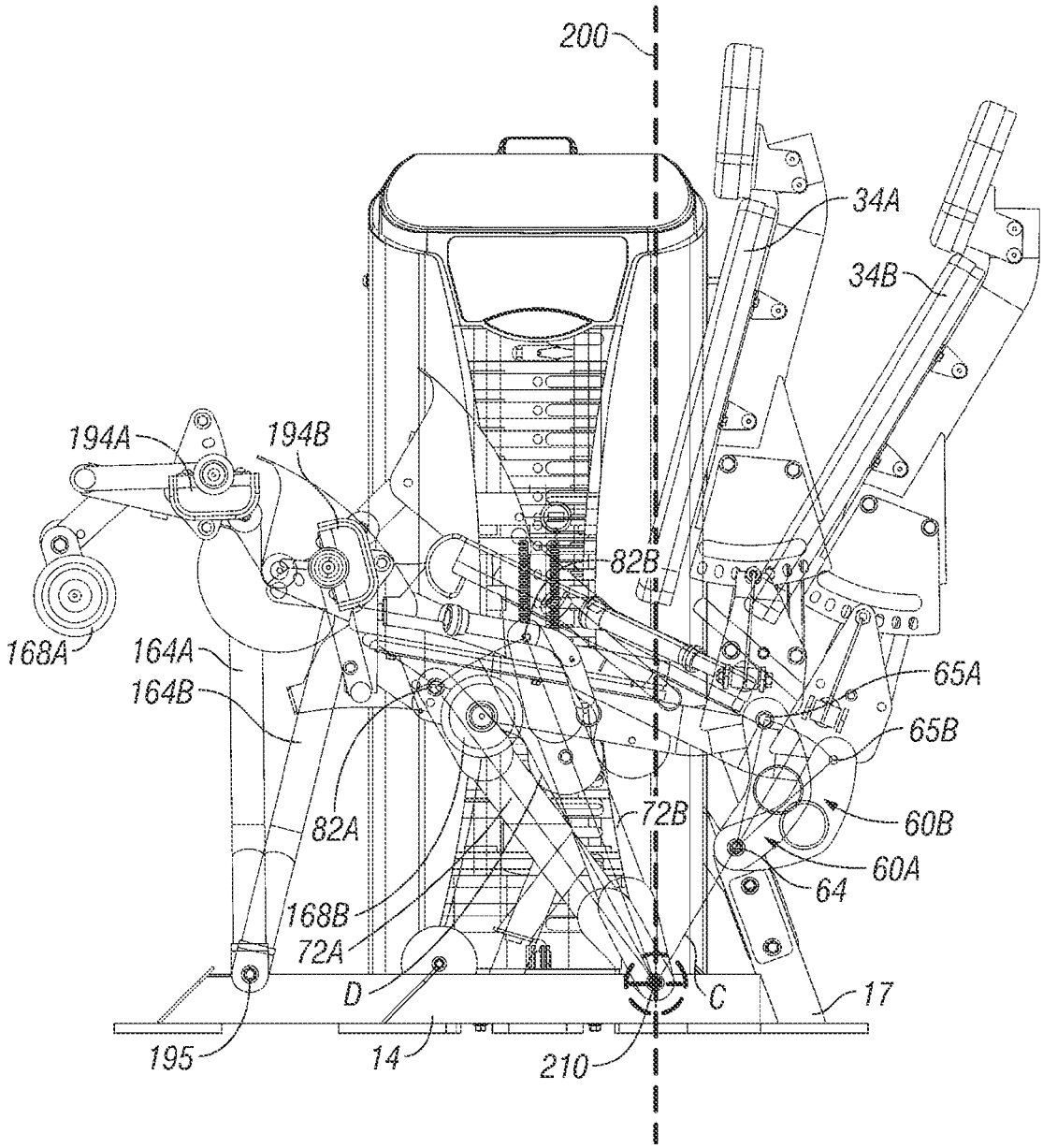
FIG. 20 is a side elevation view of the machine of FIGS. 14 to 19 with the start and finish positions of the machine superimposed.

Because the exercise arm is pivotally attached and travels with the user support and the connecting link is movably associated with the exercise arm and main frame, movement in the exercise arm translates into movement in the user support. The machine as described earlier, is connected to a vertical weight stack support frame that houses a weight stack running on two guide rods as is standard in the field FIGS. 19A and 19B show a user on the machine in the start and finish positions respectively, with the dotted line 200 representing the gravitational centerline of the pivotal movement through a theoretical pivot point. The exercise start and finish positions are superimposed in FIG. 20 to illustrate how the location of theoretical pivot point 210 may be calculated. In FIG. 20, moving parts of the machine are identified with the letter A after the corresponding reference number in the start position and with the letter B after the corresponding reference number in the finish position. The centerline C, D of the arcing movement of each of the pivot links 60, 62 is plotted (line from the midpoint of the line connecting the start and end pivot axis position through the fixed pivot axis on the base support of the main frame) and the point in space where the two centerlines intersect is the theoretical pivot point 210. Vertically bisecting this point produces the gravitational centerline 200 of the user support movement.

FIG. 20 illustrates that a single fixed pivot would work as it would be placed at approximately the same location on the main frame as the forward link 62 of the four-bar pivoting linkage system. The pivoting linkage system 18 is arranged so that a portion of the user is positioned on each side of the gravitational centerline 210 of the theoretical pivot point in both the starting and finishing positions. By linking movement of the user support to movement of the exercise arm and positioning the user support pivot so that the combined weight of the user support and user is distributed on both sides of the pivot's gravitational centerline, the user support provides a counter-balancing effect on the exercise arm as it moves and its weight is re-distributed. In the starting position more of the combined user and user support weight is distributed towards the front side of the theoretical pivot. As the exercise arm is moved, more of this combined weight passes through the gravitational centerline until a more even distribution of weight is achieved. This re-distribution is gradual and continuous throughout the exercise motion and is not noticed by the user. By starting with a portion of the combined weight on the rearward side of the gravitational centerline, the initial lifting resistance is reduced. The balanced distribution at the finish prevents resistance "drop-off" at the end of the exercise and reduces the effect the user's body weight has on the resistance.

As in the previous embodiments, the relatively flat seat in the start position makes it relatively easy to maneuver into the starting position with legs between the foot engaging pad and the hold down pad. The relatively low starting seat height makes entering, position adjustment and exiting easier. The relatively flat position of the seat provides exercise pre-stretch and may reduce stress on the knee. Since the seat is tilted and the user support is pivoted up during the exercise movement, clearance is provided for the user's feet relative to the floor during the exercise. The pivoting action also opens up the space under the seat to allow the user full range-of-motion at the end of the exercise movement. The pivoting action of the seat also drops the user's hips while it raises their knees, so that the user tends to stay firmly planted in the user support. There is no teeter-totter effect with the hips trying to lift up off of the seat because the pivoting seat is continuously moving the user's hips in the opposite, downward direction.

Figure 21:
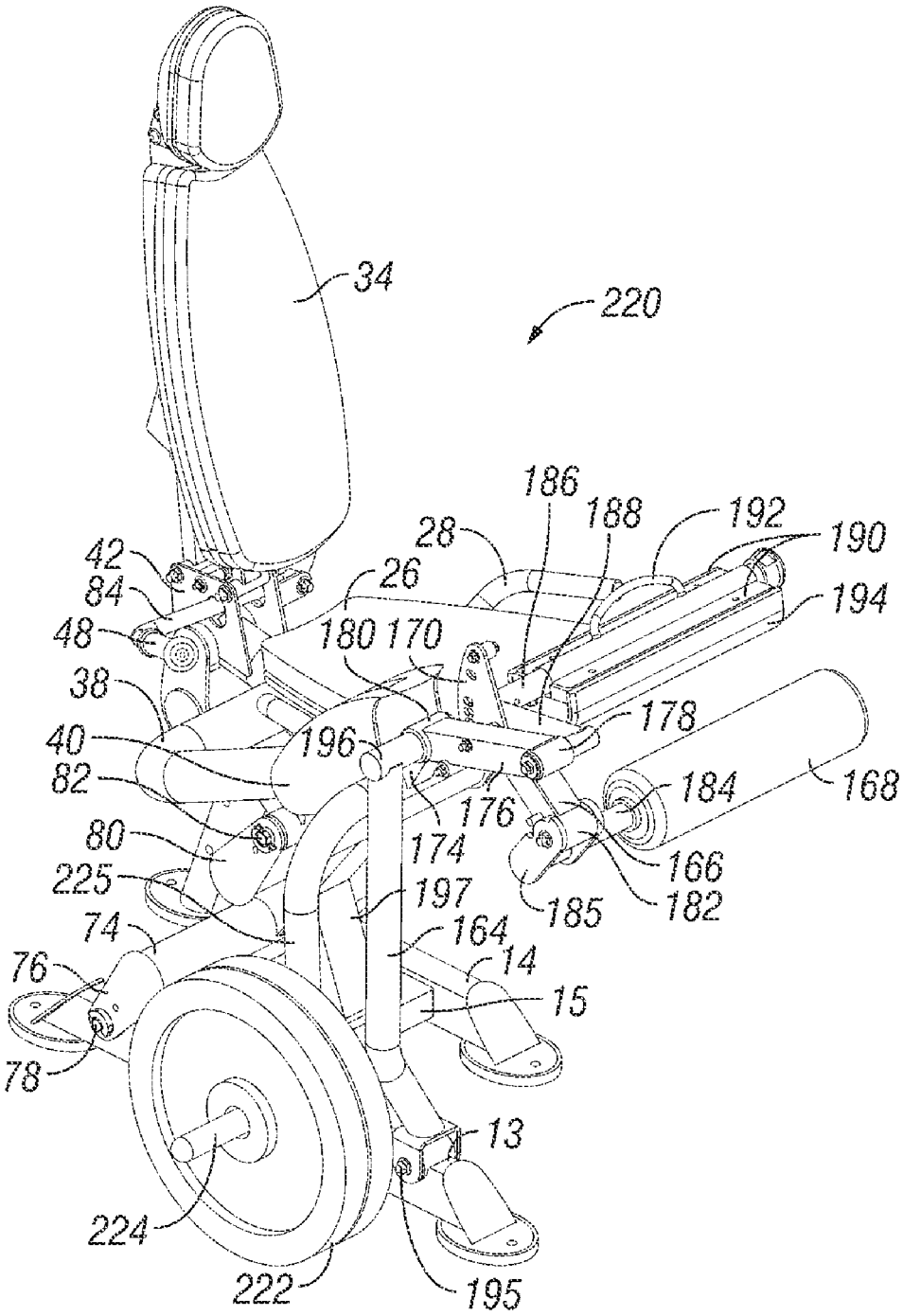
FIG. 21 is a front perspective view of a leg curl exercise machine according to another embodiment.
Figure 22:
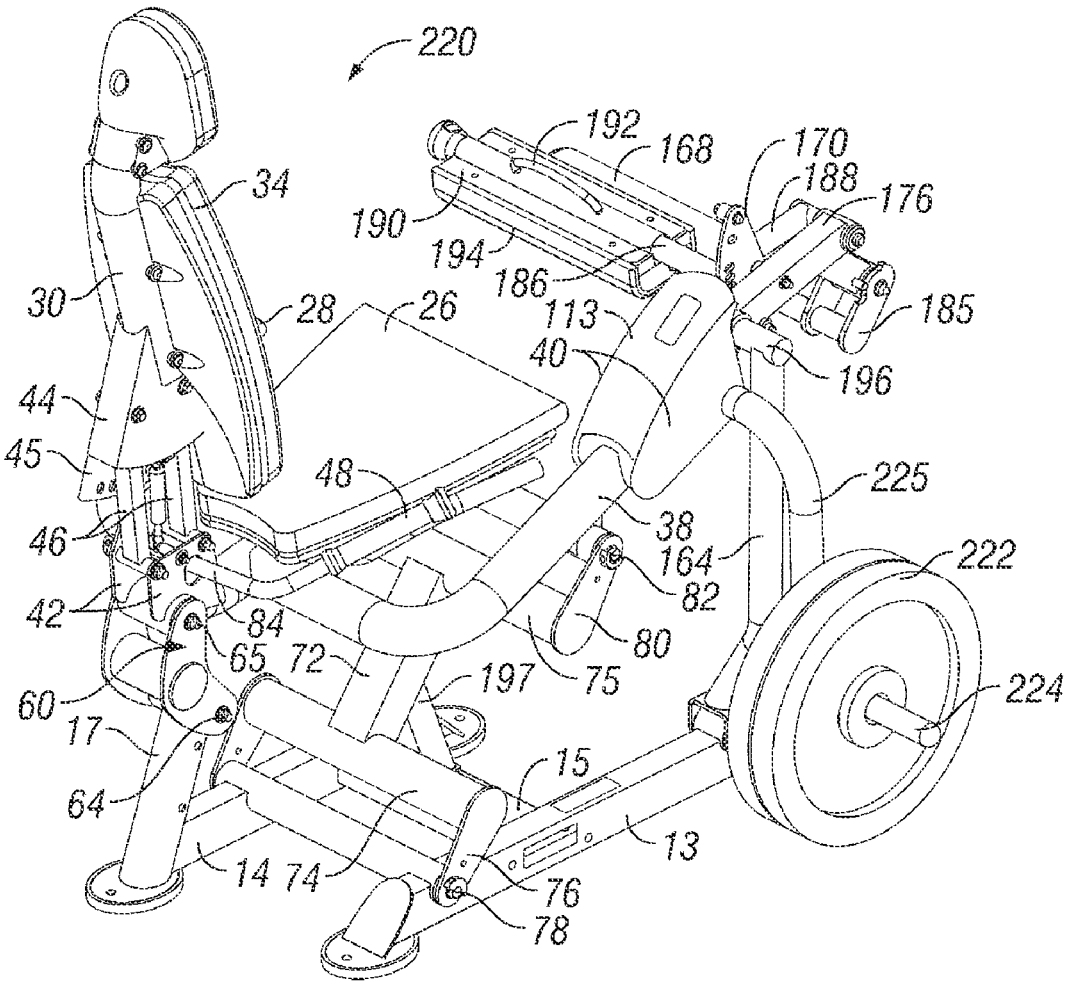
FIG. 22 is a rear perspective view of the machine of FIG. 21.
Figure 23:
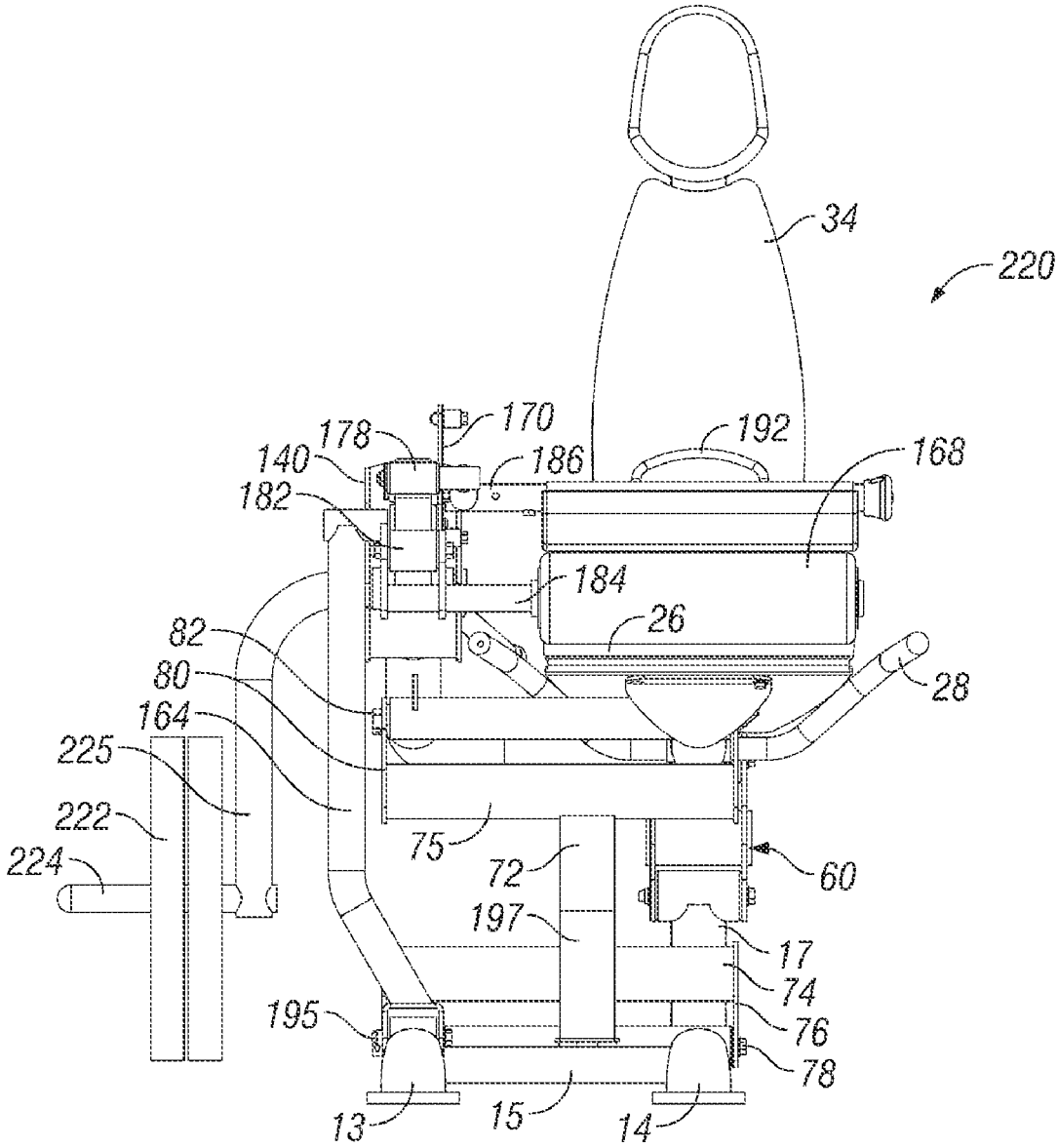
FIG. 23 is a front elevation view of the machine of FIGS. 21 and 22.
Figure 24:
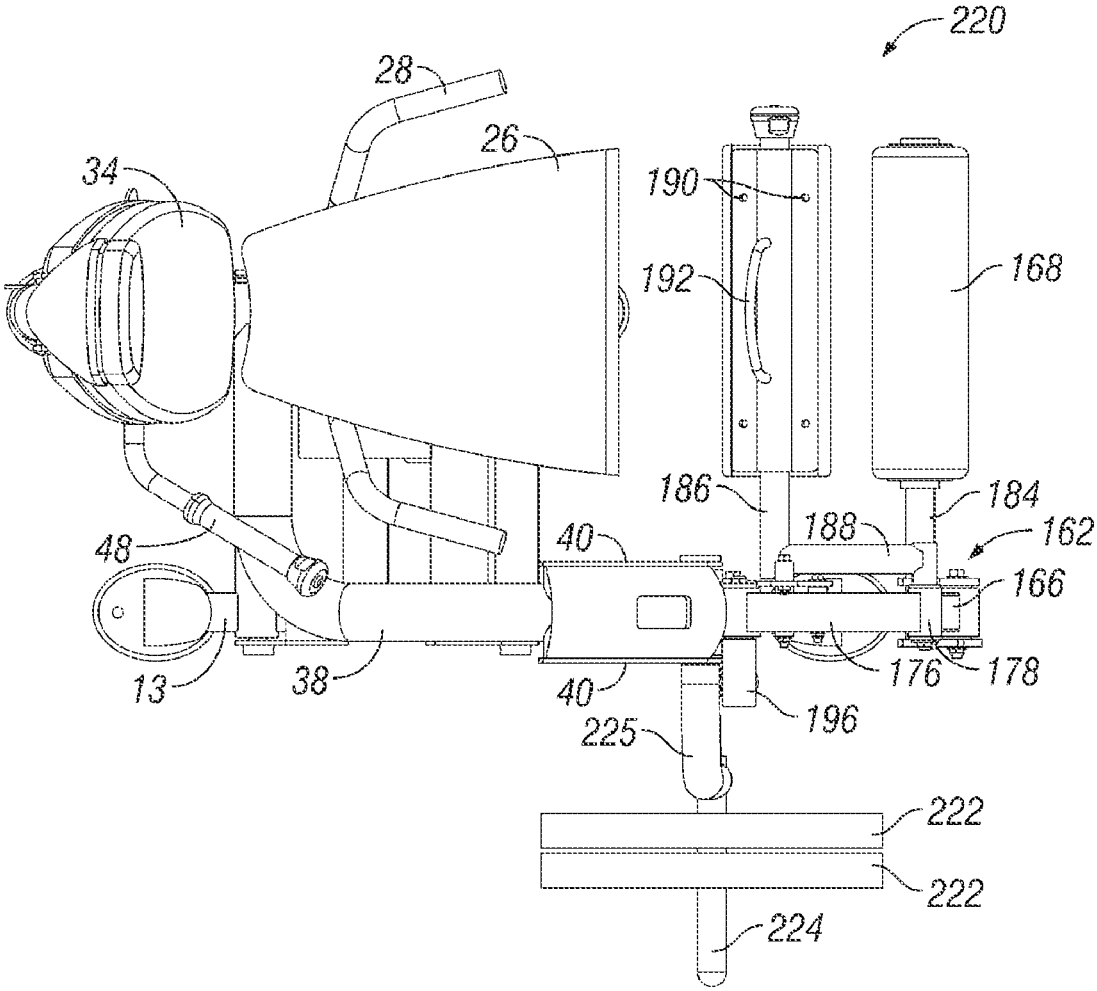
FIG. 24 is a top plan view of the machine of FIGS. 21 to 23.

FIGS. 21 to 26 illustrate a leg curl exercise machine 220 according to another embodiment. This machine is similar in most aspects to the machine of FIGS. 14 to 20, and like reference numbers are used for like parts as appropriate. However, machine 220 uses hand loaded plates 222 to supply the resistive load to the exercise arm 162, instead of a weight stack as in the previous embodiment. In this embodiment, the cam attached to the exercise arm for attaching the load transferring cable in the previous embodiment has been removed and in its place a weight receiving peg 224 is mounted one end of a lever arm 225. The second end of lever arm 225 is connected with the exercise arm at the pivotal connection of the exercise arm to the pivot bracket 40 of user support frame, as best illustrated in FIGS. 21 and 22. This allows the lever arm to move in spaced alignment with the exercise arm. The lever arm is positioned outboard of the user support area and does not intrude on the user as it swings upward.

Figure 25:
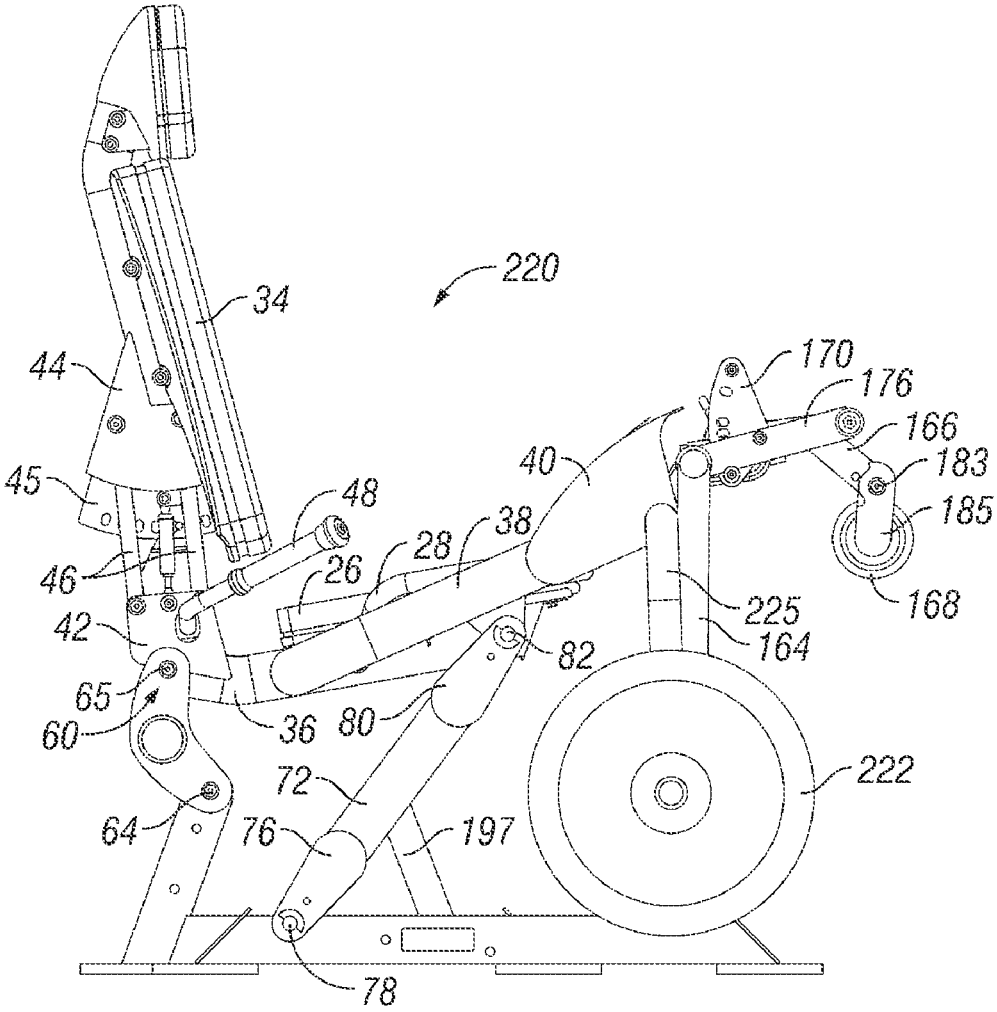
FIG. 25 is a side elevation view of the machine of FIGS. 21 to 24 in a start position for a leg curl exercise.
Figure 26:
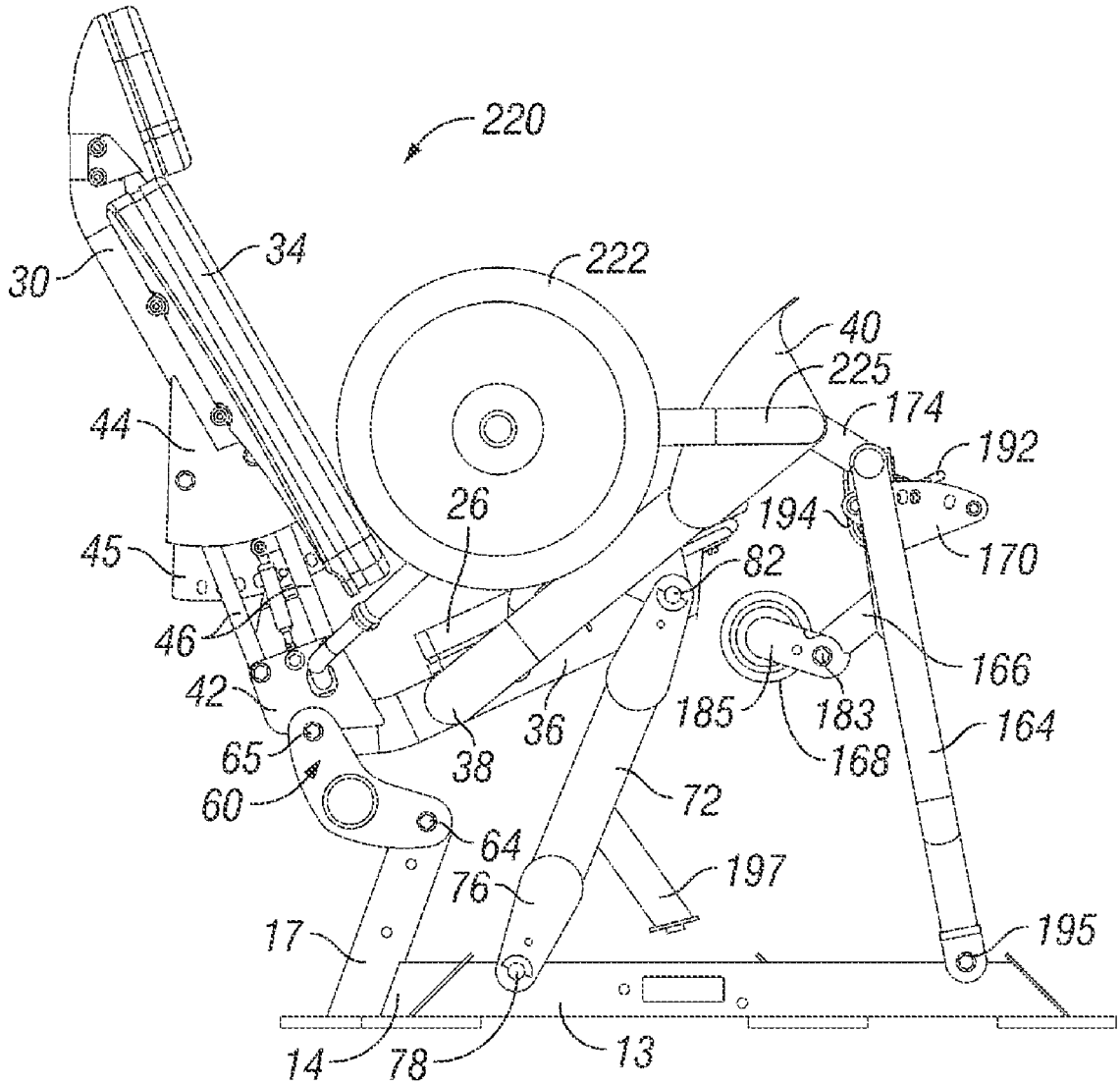
FIG. 26 is a side elevation view similar to FIG. 25 illustrating a finish position for a leg curl exercise.

The leg curl exercise machine 220 of FIGS. 21 to 26 operates in exactly the same way and has an equivalent exercise start position to the previous embodiment, as illustrated in FIG. 25, and an equivalent exercise finish position as illustrated in FIG. 26. Reference may be made to the description of the operation of the leg curl exercise machine of the previous embodiment for an understanding of the operation of leg curl machine 220.

FIGS. 27 to 32 illustrate a combination leg extension and leg curl machine 250 according to another embodiment. This machine has many of the same elements as the previous embodiments, but machine 250 utilizes an adjustable bi-directional exercise arm assembly to provide resistance for both exercise movements. Machine 250 has a main frame on which a user support 258 is pivotally mounted, and a leg exercise arm assembly 290 is pivotally mounted at a forward end of the user support. In this embodiment, movement of the leg exercise arm is linked to movement of the user support by means of a cable and pulley linkage, as explained in more detail below.

The main frame of machine 250 has a base section or tube 252 with end supports or feet 253 for engaging the floor and an inclined upright tube 254 located approximately at a mid position on the base section. A pivot mount or pivot bracket 255 is located approximate the top end of upright tube 254. A short upright post 257 is located at a forward end of base section 252. A transverse guide tube 256 for connecting to a selectorized weight stack (not illustrated) extends from the base section 252.

Figure 28:
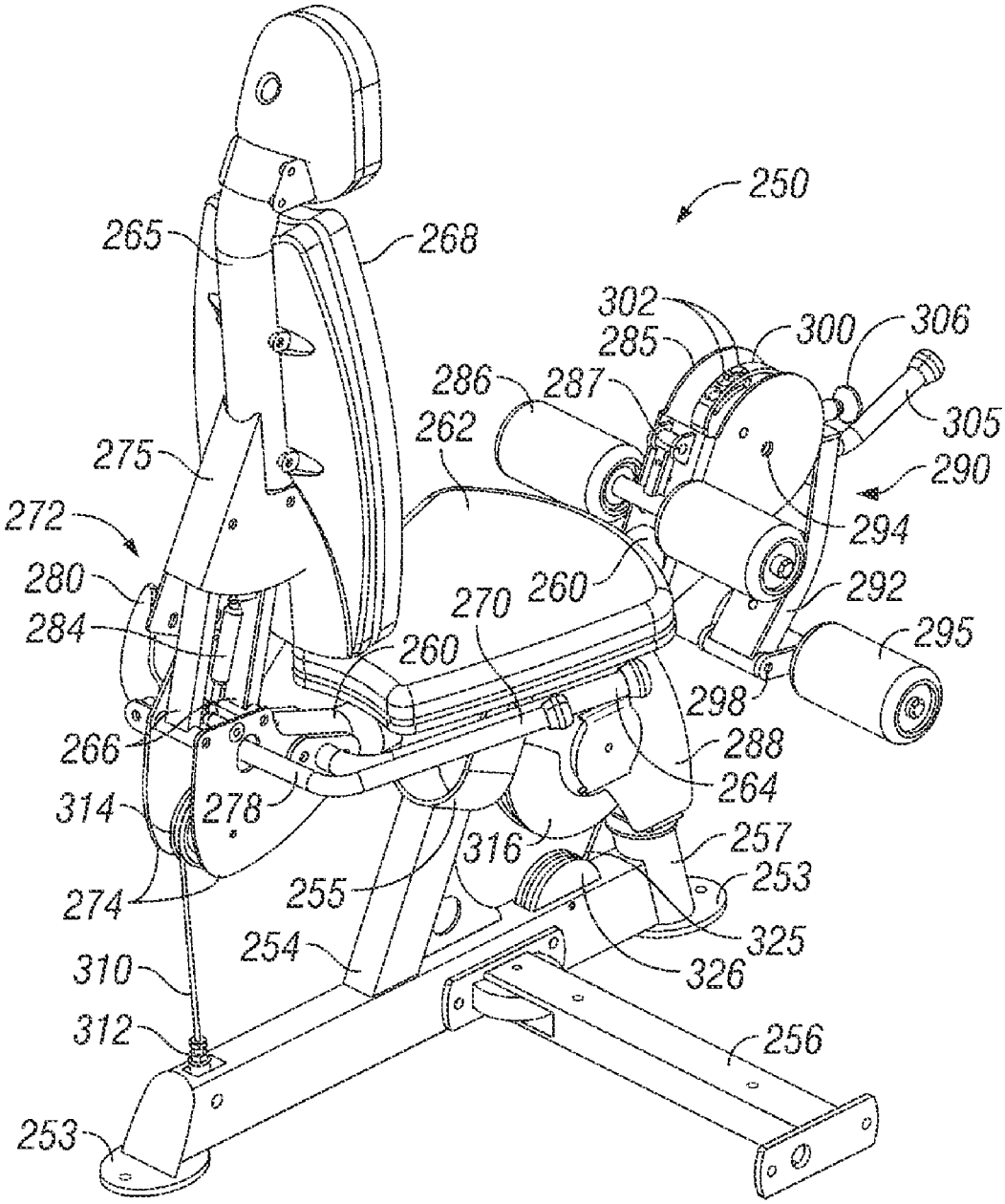
FIG. 28 is a rear perspective view of the machine of FIG. 27.
Figure 29:
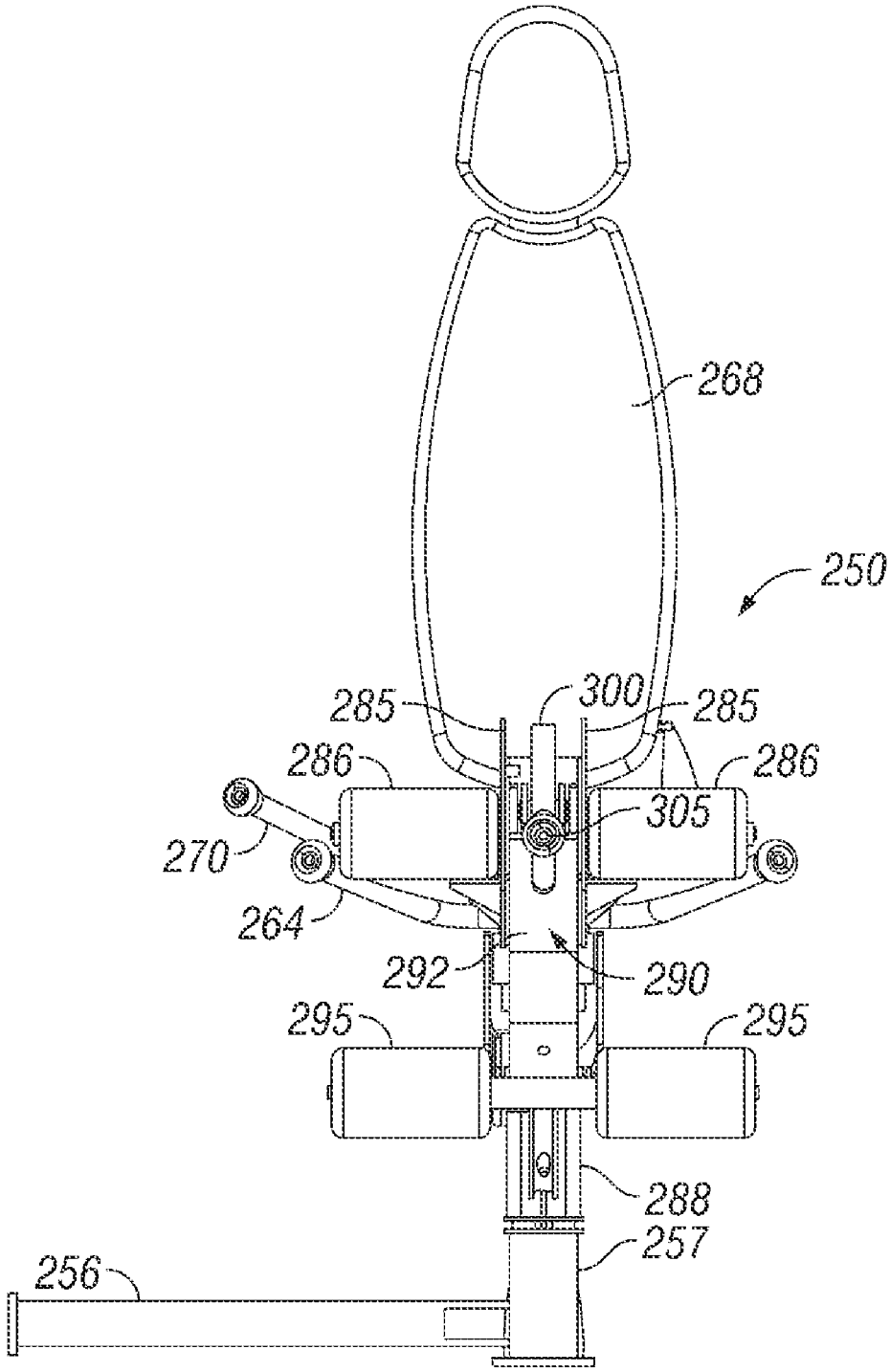
FIG. 29 is a front elevation view of the machine of FIGS. 27 and 28.
Figure 30:
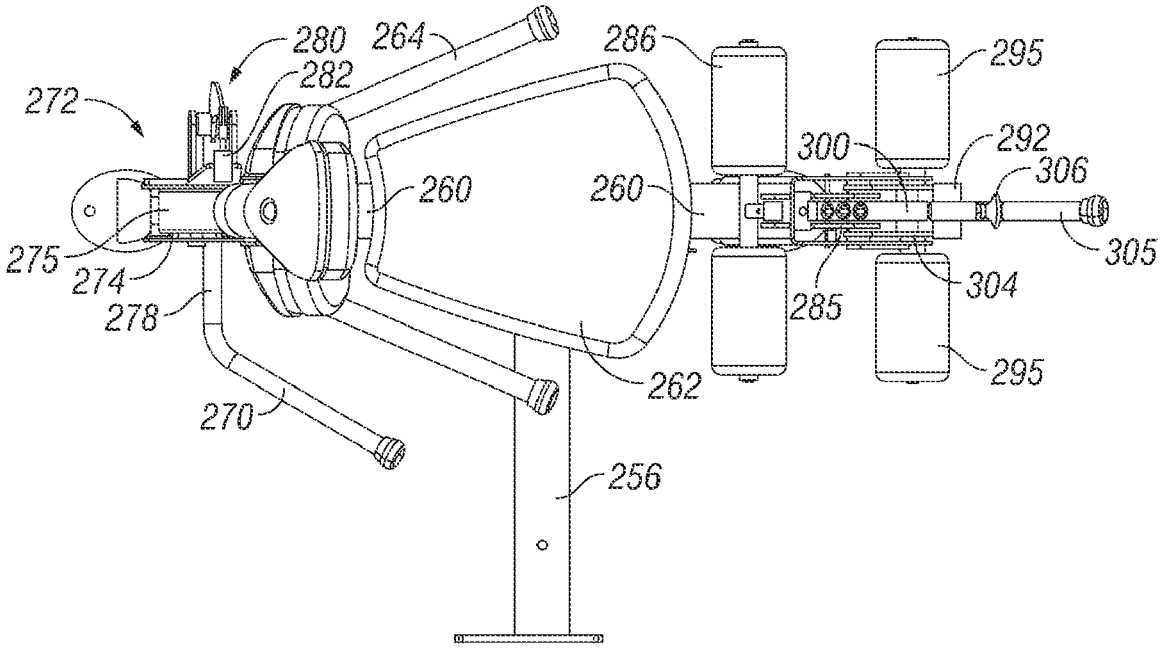
FIG. 30 is a top plan view of the machine of FIGS. 27 to 29.

The user support 258 is similar to that of the previous embodiments and has a seat frame having a seat support tube 260 with a seat pad 262 supported on top of the tube, and support handles 264 fixedly attached on opposite sides of the tube extending on opposite sides of the seat pad 262. A back rest frame 265 is adjustably mounted at the rear end of the seat support tube 260 via a four bar pivoting linkage system having a pair of linkage bars 266, as illustrated in FIG. 28. Back pad 268 is mounted in front of the back rest frame 265.

Figure 27:
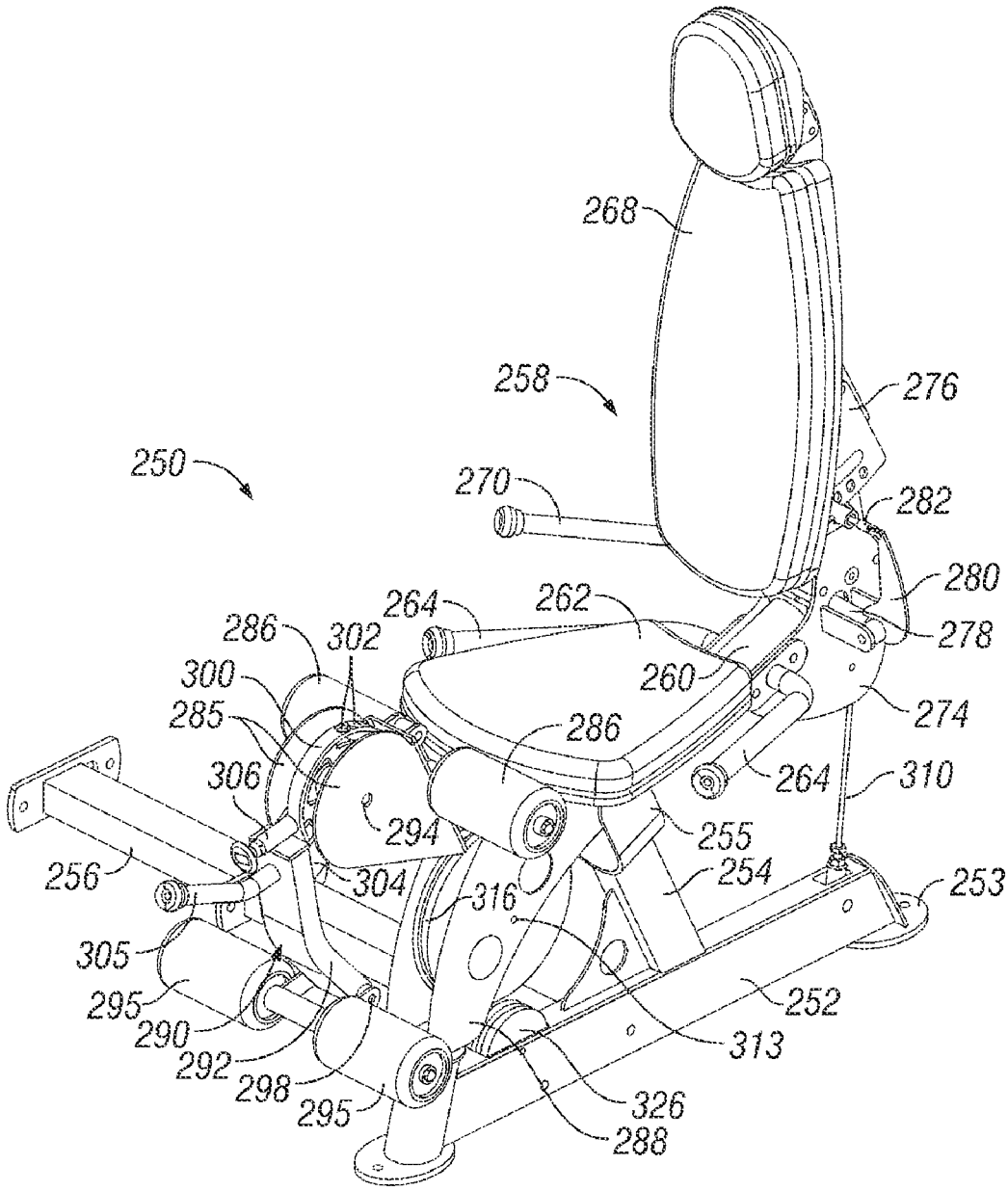
FIG. 27 is a front perspective view of a combination leg extension/leg curl exercise machine according to another embodiment.

The adjustable mounting of the back rest frame allows adjustment of the back pad orientation and position for various size users. Adjustment handle 270 allows the user to adjust the back pad position via a range-of-motion (ROM) adjuster mechanism 272 between the seat frame and back rest frame, similar to the adjuster mechanisms in the previous embodiments. ROM adjuster mechanism 272 is illustrated in FIGS. 27 and 28 and includes a pair of adjuster brackets 274 secured to the rear end of the seat support tube 260 and a ROM adjuster housing 275 at the lower end of back rest frame 265. Linkage bars 266 are pivotally secured between adjuster brackets 274 at their lower ends and between opposite sides of housing 275 at their upper ends. A range-of-motion adjuster plate 276 is fixedly attached to one face of the adjuster housing (see FIG. 27). Adjustment handle 270 has a bent shaft 278 extending through a hole in one of the adjuster brackets and is pivotally mounted to the other adjuster bracket. The shaft 278 is linked via a pull pin linkage 280 to a pull pin 282 mounted on the ROM adjuster plate 276. The pull pin 282 engages with an aligned hole in the range-of-motion plate 276 mounted on the ROM adjuster housing to provide positioning adjustment for the back pad to accommodate various size users. Release of the pull pin by pulling up on handle 270 allows the angle of the back rest to be adjusted. The handle is released when the desired orientation is reached, and the pull pin then springs back into an aligned ROM plate opening. A gas-assist return shock device 284 extends between adjuster bracket 274 and the adjuster housing to return the back rest to a forward position when released.

Figure 31A:
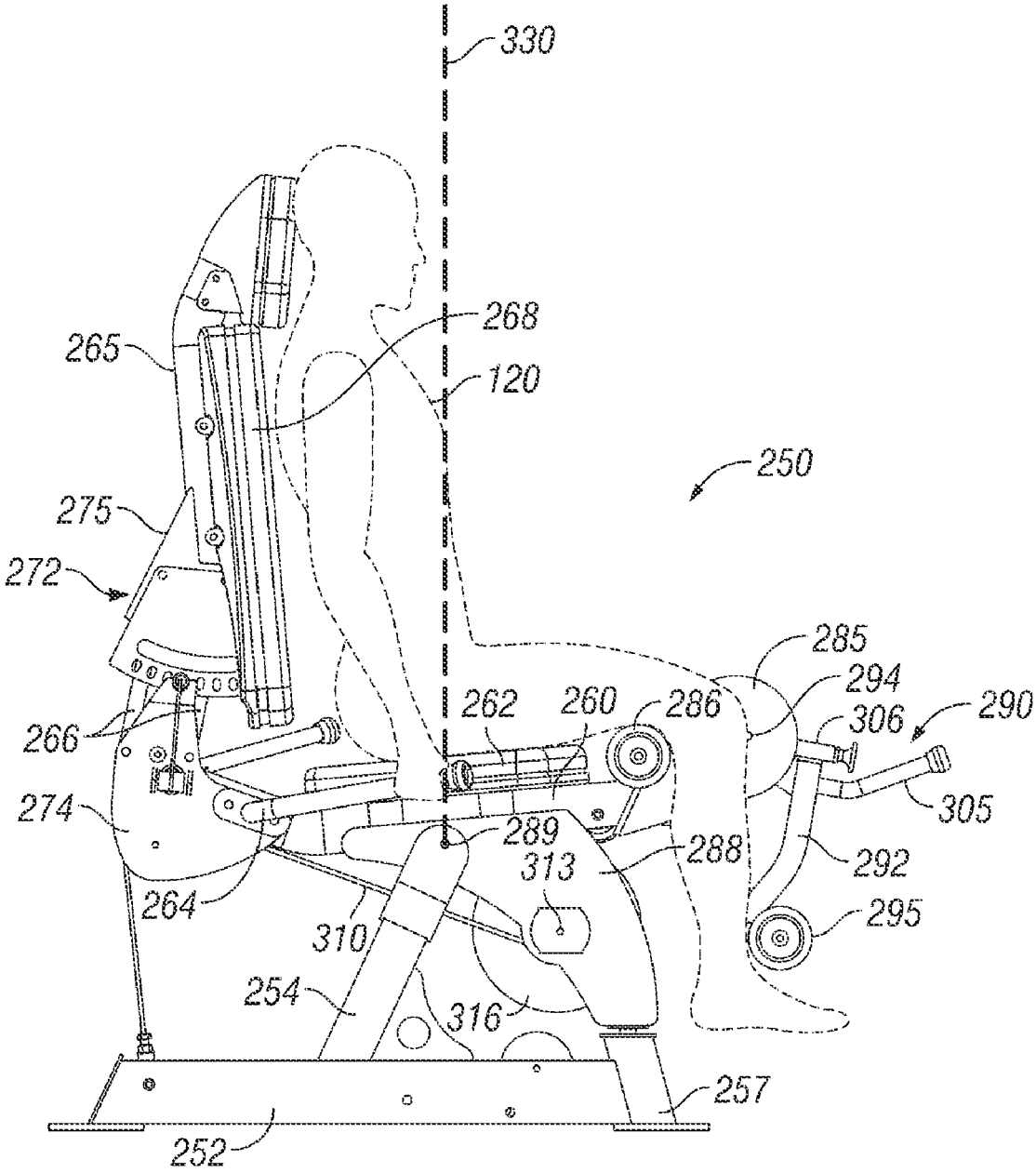
FIG. 31A is a side elevation view illustrating the machine of FIGS. 27 to 30 in a start position for a leg extension exercise, with a user seated on the machine and ready to perform the exercise.
Figure 31B:
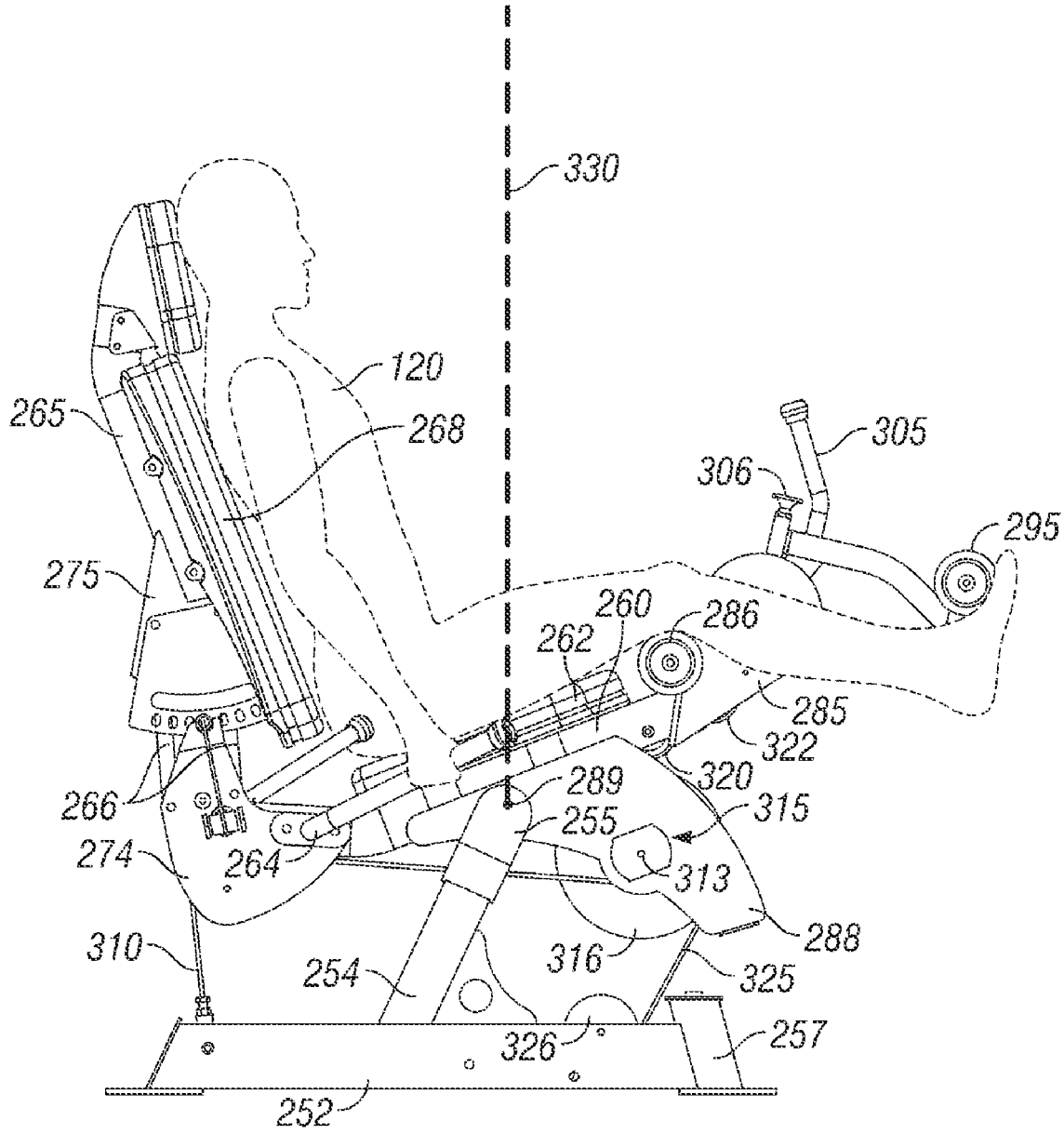
FIG. 31B is a side elevation view similar to FIG. 31A but illustrating a finish position for the leg extension exercise.
Figure 32A:
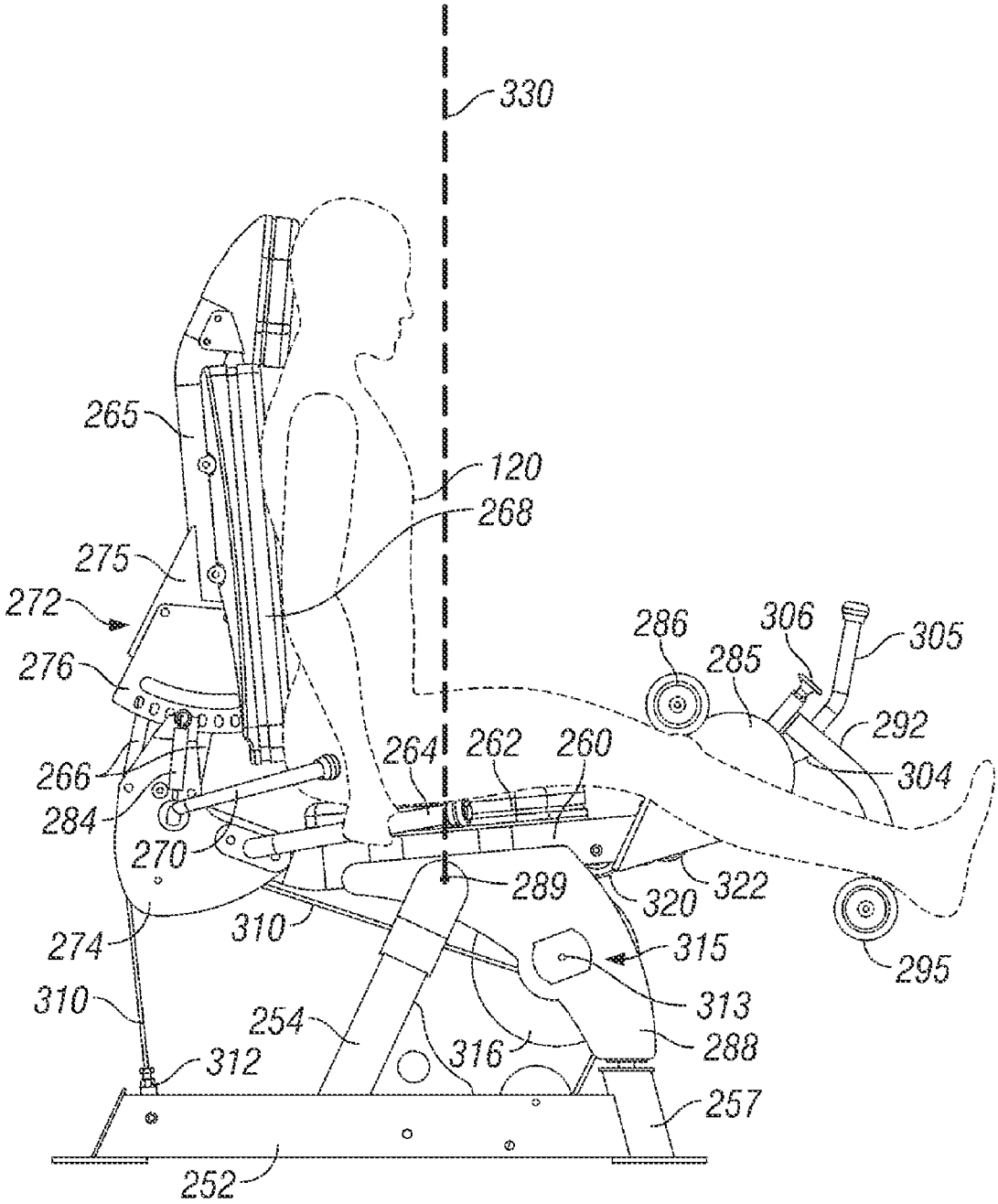
FIG. 32A is a side elevation view illustrating the machine of FIGS. 27 to 30 in a start position for a leg curl exercise, with a user seated on the machine and ready to perform the exercise.
Figure 32B:
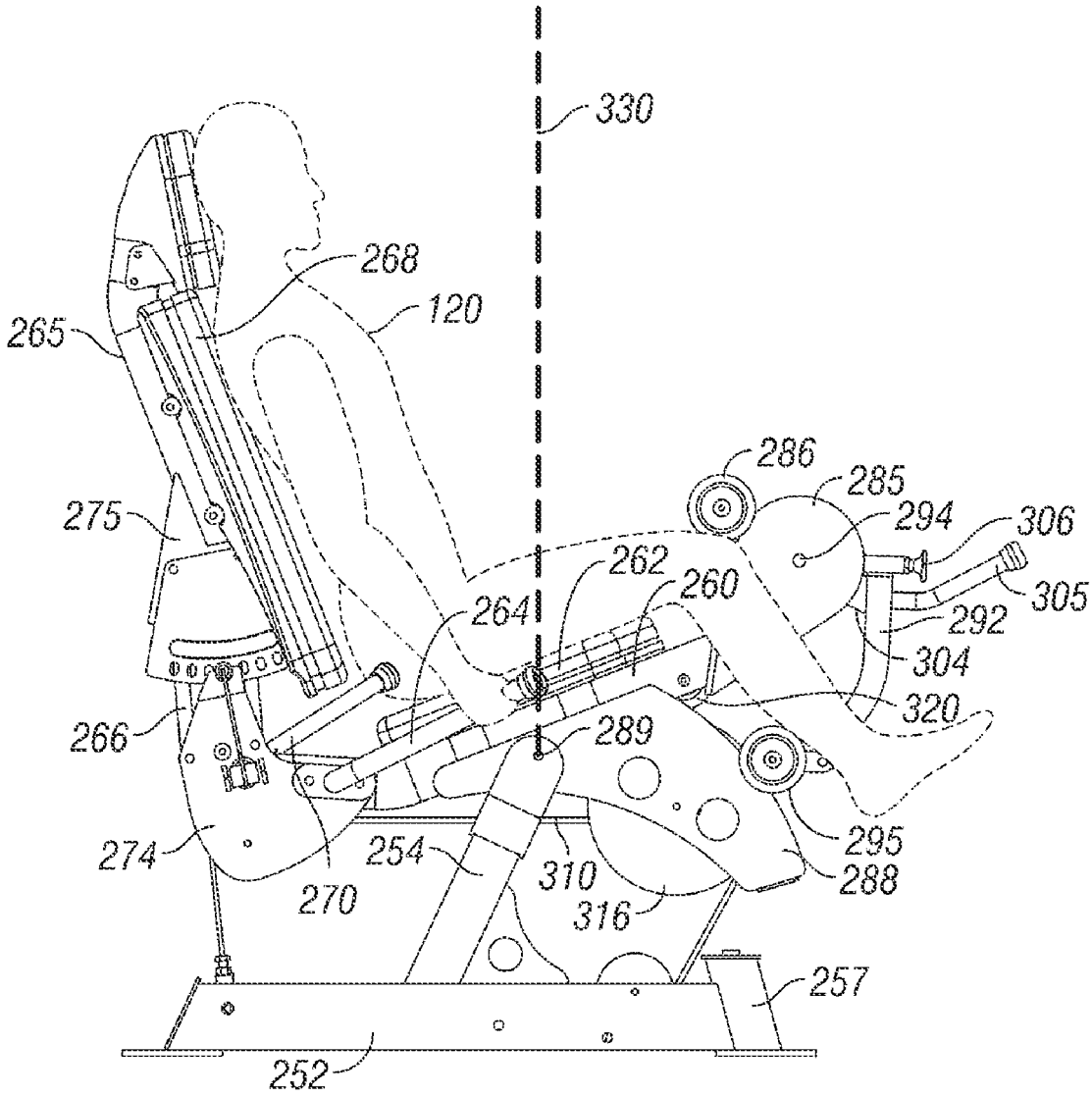
FIG. 32B is a side elevation view similar to FIG. 32A but illustrating a finish position for the leg curl exercise.

The adjuster handle 270 and associated structure may be custom designed for either left or right handed users, as illustrated in the drawings. In FIGS. 27 to 30 and 32A, handle 270 is on the right hand side of the seat for convenient use by right hand users, while FIGS. 31A, 31B and 32B illustrate a variation in which handle 270 is on the left hand side of the seat for left hand users, and the remainder of the adjustment mechanism on the rear of the seat is similarly reversed. The exercise machine in these figures is otherwise identical to that of FIGS. 27 to 30 and 32A.

U-shaped pivot bracket 285 is attached approximate the forward end of the seat support tube 260, and a pair of thigh brace pads or rollers 286 are pivotally attached to the rear side of pivot bracket 285. A pair of large mounting plates 288 is mounted on the underside of seat support tube 260. The seat support tube 260 is pivotally attached to main frame pivot mount 255 for rotation about user support pivot axis 289, the user support pivot mount being housed between mounting plates 288. Mounting plates 288 engage a bumper pad on the end of post 257 on the main frame in the rest or exercise start position, as illustrated in FIGS. 28, 31A and 32A.

The exercise arm assembly 290 comprises a main tube 292 which is pivotally mounted at one end between pivot brackets 285 for rotation about pivot axis 294, and user engaging rollers or pads 295 pivotally mounted approximate the other end of tube 292 for rotation about pivot axis 298 (see FIG. 28). The pivotal connection between the user engaging rollers and the main tube 292 enables the user engaging device to self-align to the user during the exercise and automatically adjust to the user's leg length.

A range-of-motion adjuster for the exercise arm assembly comprises a round cam 300 pivotally mounted between the user support pivot brackets 285. Cam 300 has spaced adjustment holes 302 around its circumference, for selective engagement with a pull pin or adjuster pin 306 at the end of the main tube 292 of the exercise arm assembly. Mounting brackets 304 approximate the first end of the main tube extend between the pivot brackets 285 and are pivotally mounted on the pivot pin which extends between the brackets 285. An adjuster handle 305 is attached to the main tube opposite the mounting brackets 304. The user can grip handle 305 while pulling out pull pin 306 from the ROM cam 300 and rotate the exercise arm assembly 290 to a desired position before releasing pin 306 to engage in an aligned hole 302 in the ROM adjuster. This allows the orientation of the exercise arm to be adjusted for leg exercise or leg curl exercises.

The connecting link between the exercise arm and user support comprises a pulley and cable system having a first cable 310 attached to the base section 252 of the main frame at anchor 312, reeved around a pulley 314 mounted between the adjuster brackets 274 attached to the rear of seat support tube 260 (FIG. 28), and finally anchoring to a dual cam 315 pivotally mounted between large mounting plates 288 in front of the user support pivot mount for rotation about pivot axis 313. The dual cam 315 comprises first and second coaxially mounted cams of different diameter, with only the larger diameter cam 316 being visible in FIG. 27. The first cable is anchored to the smaller cam of the two cams, to wrap around the cam in a counter-clockwise direction. A second cable, which is not visible in the drawings, is anchored to the larger diameter cam 316 of the dual cams to wrap around the cam in a clockwise direction, and is reeved around two pulleys 320, 322 on the user support before anchoring to the range-of-motion cam 300. The first pulley 320 is mounted at the forward end of seat support tube 260, and part of this pulley can be seen in FIGS. 31 and 32. The second pulley 322 is mounted between pivot brackets 285 and a small part of this pulley is also visible in FIGS. 31 and 32. The linkage is connects to rock the user support back in the same direction regardless of the type of leg exercise performed, as explained below.

In this embodiment, exercise resistance or load is supplied by a cable and pulley system connected to a weight stack. The weight stack is not illustrated in FIGS. 27 to 32 but may be equivalent to the weight stack arrangements illustrated in the embodiments of FIGS. 1 to 7 and 14 to 20. The load supplying cable and pulley system includes a load cable 325 anchored to the large mounting plates 288 under the seat support tube 260 and extending around a pulley 326 in the base section 252 of the main frame, as illustrated in FIGS. 27 and 28. From here, the cable extends around additional pulleys and through guide tube 256 where it is linked to the weight stack in any suitable manner.

FIGS. 31A and 31B illustrate a user 120 performing a leg extension exercise on machine 250. For this exercise, the user starts with their legs bent and then extends the legs forwardly. The exercise arm must therefore be positioned in a down position for the start of this exercise, as illustrated in FIG. 31A. The user moves the exercise arm into the start position by adjusting the position of the upper end of the main tube 292 in ROM adjuster cam 300 so that the exercise arm extends downward. Thigh brace pads 286 are rotated down about pivot axis 287 into their lowermost position for a leg extension exercise.

In the start position, user 120 sits on the seat with their back against the back pad, knees bent over the thigh brace pads 286, and their feet behind the leg engaging rollers 295. They may grab the support handles 264 for additional bracing if desired. They then start the exercise movement by extending their lower legs outward. This movement causes the exercise arm to pivot about pivot axis 294 at its connection to the user support, which pulls the second cable attached to the larger cam 316 of the dual cam, causing the cam to rotate and pull the first cable 310 as it wraps around the smaller cam of the dual cam. This causes the user support to pivot rearward about pivot axis 289 at its pivotal connection to the main frame. As the user support tilts rearward, lifting its front end, the load bearing cable 325 is pulled, providing resistance. FIG. 31B illustrates the finish position for a leg extension exercise. The vertical line 330 in FIGS. 31A and 31B illustrates the gravitational center line extending through the user support pivot axis 289.

FIGS. 32A and 32B illustrate the start and finish position of a leg curl exercise on machine 250. In order to perform a leg curl exercise, the user 120 adjusts the exercise arm 290 to extend outward by pulling pull pin 306 from the aligned hole in ROM cam 300 and then pulling up on handle 305 until the exercise arm 290 is in the correct position, releasing pin 306 to extend into the aligned opening 302. The user sits on the seat pad 262 with their back against the back pad 268. The thigh brace rollers 286 are pivoted up to rest on top of the user's legs and the user's feet rest on top of the leg engaging rollers 295. The user may grab the support handles 264 for additional bracing if desired. They then start the exercise movement by curling their lower legs downward and continue to bend their legs down until the finish position is reached. This action causes the same reaction as the leg extension, pulling the cable attached to the large cam 316 of the dual cam so that the cam rotates and winds cable 310 onto the smaller cam. This in turn causes the user support to pivot back about pivot axis 289 into the reclined position of FIG. 32B.

In this embodiment, a user can selectively perform either a leg extension or a leg curl exercise. In either case, the user support moves from a relatively flat start position which is at or close to horizontal into a rearwardly inclined finish position. As in the previous embodiments, the user supporting seat and back pad travel together in this embodiment, to keep the user in the same position throughout the exercise motion. The user does not have to worry about balancing on a moving platform or pad. The combined exercise arm and user support movement provides a self-aligning exercise motion that allows the user to achieve a full range of exercise motion. The user can easily switch between a leg extension and a leg curl exercise simply by releasing pull pin 306 from the ROM plate and rotating the exercise arm to the proper start position.

In each of the above embodiments, movement of the user support is linked to movement of the exercise arm and the user support pivot or theoretical pivot is positioned so that the combined weight of the user support and user is distributed on both sides of the gravitational centerline of the pivot, the user support provides a counter-balancing effect on the exercise arm as it moves and its weight is re-distributed. This balanced weight distribution results in a portion of the user and user support to be position on each side of the gravitational centerline in both the start and finish positions. As the exercise arm is moved, a portion of this combined weight passes through the gravitational centerline redistributing the weight. This re-distribution is gradual and continuous throughout the exercise motion and is not noticed by the user.

The embodiments of FIGS. 1 to 26 all have four-bar pivoting linkage system between the user support and main frame. This can allow a desired pivoting movement to be achieved when a single pivot point for producing the same motion may be located in an area impossible to access due to either structural or user interference. FIGS. 27 to 32 use a single user support pivot mount to achieve the desired motion.

The machine of each of the previous embodiments is configured to change the elevation of the user knees to their hips during the exercise to keep the user firmly planted in the seat and improve the feel of the exercise. The rocking movement of the user support makes the exercise more fun to perform. Repetitious exercise movement can be tedious and boring. By adding motion to the user support, performing the exercise may be more enjoyable and the users interest in their workout may increase. This is a benefit to both the individual user, who may exercise more regularly, and the fitness facility, where retention of members is a primary objective.

It should be understood that all the different elements used in the various embodiments may be mixed and interchanged with one another. The seat and/or back pad could be fixed or made adjustable. Various different types of user engaging pads can be used. The exercise arm could be unidirectional or bi-directional, and may be rigid or flexible. The connecting link which links movement of the exercise arm to movement of the user support could be made adjustable, solid links could be replaced with flexible ones, and the connecting links could be made to push or pull to urge rotation of the user support. Any of the various embodiments could have the resistance associated with any of the moving parts (user support, exercise arm or connecting link).

It should also be noted that others skilled in the art could use different types and forms of components without affecting the scope of this invention. Cables could be replaced with belts, ropes, chains or the like, and pulleys could be replaced with sprockets, and the seat and back pad could be made adjustable. Other types of resistance know to the art could by used such as hydraulic, pneumatic, electromagnetic or elastic bands.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A leg exercise machine, comprising:

a main frame having a front end and a rear end;

a user support pivot mount on the main frame;

a user support pivotally mounted on the user support pivot mount for rotation about a pivot axis relative to the main frame and moving in a first direction between a start position and an end position during a leg exercise, the user support having a seat portion and a backrest portion which support a user in a seated position during a leg exercise, the seat and backrest portions being in a fixed orientation relative to one another during an exercise movement and moving together in the same relative orientation to one another throughout the exercise movement, the seat portion having a rear end and a forward end and rotating downwardly at its rear end and upwardly at its forward end between the start and end positions of the leg exercise;

the user support pivot mount comprising a four bar linkage between the user support and main frame, the four bar linkage defining a theoretical pivot axis of the user support pivotal movement, all pivot connections between the four bar linkage and the main frame being located no higher than the seat portion of the user support;

at least one leg exercise arm movably mounted relative to the main frame and having a leg engaging device for engagement by the legs of a user seated on the user support to perform a leg exercise;

a connecting link which links movement of the exercise arm by a user performing a leg exercise to movement of the user support from the start position to the end position; and a load which resists movement of at least one of the user support, exercise arm, and connecting link.

2. The machine of claim 1, wherein the four bar linkage comprises a first pivot link having a first end pivotally connected to the main frame for rotation about a first pivot axis and a second end pivotally connected to the user support for rotation about a second pivot axis, and a second pivot link having a first end pivotally connected to the main frame at a location spaced forward from the first pivot axis for rotation about a third pivot axis, and a second end pivotally connected to the user support at a location spaced forward from the second pivot axis for rotation about a fourth pivot axis.

3. The machine of claim 1, wherein the four bar linkage is configured to produce pivotal movement of the user support about a predetermined theoretical pivot axis.

4. The machine of claim 3, wherein the main frame has a base portion which engages the ground and the theoretical pivot axis is located no higher than the base portion.

5. The machine of claim 4, wherein the theoretical pivot axis is below the base portion.

6. A leg exercise machine, comprising:

a main frame having a front end and a rear end;

a user support pivotally mounted relative to the main frame and moving in a first direction between a start position and an end position during a leg exercise, the user support having a seat portion and a backrest portion which support a user in a seated position during a leg exercise, the seat and backrest portions being in a fixed orientation relative to one another during an exercise movement and moving together in the same relative orientation to one another throughout the exercise movement, the seat portion having a rear end and a forward end and rotating downwardly at its rear end and upwardly at its forward end between the start and end positions of the leg exercise;

at least one leg exercise arm movably mounted relative to the main frame and having a leg engaging device for engagement by the legs of a user seated on the user support to perform a leg exercise;

a connecting link which links movement of the exercise arm by a user performing a leg exercise to movement of the user support from the start position to the end position; and a load which resists movement of at least one of the user support, exercise arm, and connecting link;

the user support being pivotally mounted relative to the main frame for rotation about a user support pivot axis defining a vertical gravitational center line of the pivotal movement of the user support, the user support pivot axis being positioned at a predetermined location such that portions of the combined weight of the user and user support are distributed on each side of the gravitational center line in at least one of the start and end positions of a leg exercise movement.

7. The machine of claim 6, further comprising a range of motion (ROM) adjuster between the seat portion and the back rest portion which adjusts the orientation of the back rest portion relative to the seat portion, and a locking device which releasably locks the back rest portion at a selected orientation.

8. The machine of claim 6, wherein the seat portion is oriented at or close to a horizontal orientation in the start position, and is reclined rearwards in the end position.

9. The machine of claim 6, further comprising a user support pivot mount comprising a four bar pivot linkage between the user support and main frame, the four bar pivot linkage defining a user support pivot axis comprising a theoretical pivot axis about which the user support rotates between the exercise start and end positions.

10. The machine of claim 6, wherein the seat portion of the user support has a forward end and the leg exercise arm is pivotally linked to the user support for rotation about an exercise arm pivot axis spaced forward from the forward end of the seat portion.

11. The machine of claim 10, wherein the connecting link comprises a pivot link between the leg exercise arm and the main frame.

12. The machine of claim 10, wherein the leg exercise arm has a first end portion pivotally mounted on the user support on one side of the seat portion and a second end portion extending forward from the seat portion, the leg engaging device extending transversely from the second end portion in front of the seat portion.

13. The machine of claim 10, wherein the leg engaging device comprises a pad which is adapted to engage a front portion of the legs above the feet of a user seated on the user support and performing a leg extension exercise.

14. The machine of claim 10, wherein the leg engaging device comprises a first pad which is adapted to engage behind the legs of a user seated on the user support and performing a leg curl exercise, and a second, hold down pad spaced above the first pad which is adapted to engage in front of the user's legs.

15. The machine of claim 10, wherein the leg exercise arm is movable between a start position extending downward from the exercise arm pivot axis and an end position extending forward from the exercise arm pivot axis.

16. The machine of claim 10, wherein the leg exercise arm is movable between a start position extending forward from the exercise arm pivot axis and an end position extending generally downward from the exercise arm pivot axis.

17. The machine of claim 10, wherein the exercise arm comprises a bi-directional exercise arm rotatable in a first direction about said exercise arm pivot axis to perform a leg extension exercise and in a second, opposite direction about said exercise arm pivot axis to perform a leg curl exercise.

18. The machine of claim 17, further comprising an adjustment device between the exercise arm and user support for user adjustment of the start position of the exercise arm between a first start position extending generally downwardly from the exercise arm pivot axis for performing a leg extension exercise and a second start position extending generally forward from the exercise arm pivot axis for performing a leg curl exercise.

19. The machine of claim 6, further comprising support handles fixed on opposite sides of the user support for gripping by a user when performing a leg exercise.

20. The machine of claim 6, wherein the load comprises an adjustable load which provides at least a major portion of the exercise resistance during an exercise and the location of the user support pivot axis is unchanged by adjustment of the load.

21. An isolation exercise machine for performing an isolation exercise, comprising:

a main frame having a front end and a rear end;

a user support pivotally mounted relative to the main frame and moving in a predetermined arcuate path between a start position and an end position during an isolation exercise, the user support having a seat portion and a backrest portion which support a user in a seated position during an isolation exercise, the seat and backrest portions being in a fixed orientation relative to one another during an exercise movement and moving together in the same relative orientation to one another throughout the isolation exercise, the seat portion moving between a first orientation in the start position and a second, more rearwardly reclined orientation in the end position of the isolation exercise, the seat portion having a rear end which is at a first elevation at the start position of an isolation exercise and is at a second, lower elevation at the end position of the exercise;

at least one user engagement device movably mounted relative to the main frame and having a user engaging portion for engagement by a user seated on the user support when performing an isolation exercise;

a connecting link which links movement of the user engagement device by a user performing an exercise to movement of the user support from the start position to the end position; and a load which resists movement of at least one of the user support, user engagement device, and connecting link.

22. The machine of claim 21, wherein the connecting link is a flexible link.

23. The machine of claim 21, further comprising a user support pivot mount between the user support and main frame, the user support pivot mount defining a user support pivot axis located directly beneath the seat portion of the user support.

24. A leg exercise machine, comprising:

a main frame having a front end and a rear end;

a user support pivotally mounted relative to the main frame and moving in a first direction between a start position and an end position during a leg exercise, the user support having a seat portion and a backrest portion which support a user in a seated position during a leg exercise, the seat and backrest portions being in a fixed orientation relative to one another during an exercise movement and moving together in the same relative orientation to one another throughout the exercise movement, the seat portion having a rear end and a forward end and rotating downwardly at its rear end and upwardly at its forward end between the start and end positions of the leg exercise;

a user support pivot assembly between the main frame and user support, the assembly comprising at least one pivot link having a first end pivoted to the main frame for rotation about a first pivot axis and a second end pivoted to the user support for rotation about a second pivot axis, the first pivot axis being located directly below the seat portion of the user support;

at least one leg exercise arm movably mounted relative to the main frame and having a leg engaging device for engagement by the legs of a user seated on the user support to perform a leg exercise;

a connecting link which links movement of the exercise arm by a user performing a leg exercise to movement of the user support from the start position to the end position; and a load which resists movement of at least one of the user support, exercise arm, and connecting link.

25. A leg exercise machine, comprising:

a main frame having a front end and a rear end;

a user support pivotally mounted for rotation about a pivot axis relative to the main frame and moving in a first direction between a start position and an end position during a leg exercise, the user support having a seat portion and a backrest portion which support a user in a seated position during a leg exercise, the seat and backrest portions being in a fixed orientation relative to one another during an exercise movement and moving together in the same relative orientation to one another throughout the exercise movement, the seat portion having a rear end and a forward end and rotating downwardly at its rear end and upwardly at its forward end between the start and end positions of the leg exercise;

a user support pivot assembly between the main frame and user support, the user support pivot assembly having a plurality of pivots which are all located below the level of a user engaging surface of the seat portion at least in the exercise start position;

at least one leg exercise arm movably mounted relative to the main frame and having a leg engaging device for engagement by the legs of a user seated on the user support to perform a leg exercise;

a connecting link which links movement of the exercise arm by a user performing a leg exercise to movement of the user support from the start position to the end position; and an adjustable load which resists movement of at least one of the user support, exercise arm, and connecting link.

* * * * *